US009921541B2

(12) United States Patent
Shimizu et al.

(10) Patent No.: US 9,921,541 B2
(45) Date of Patent: Mar. 20, 2018

(54) DEVELOPING DEVICE, AND IMAGE FORMING APPARATUS AND PROCESS CARTRIDGE INCORPORATING SAME

(71) Applicants: Yasunobu Shimizu, Kanagawa (JP); Akira Azami, Kanagawa (JP); Masaaki Yamada, Tokyo (JP); Yoshiko Ogawa, Tokyo (JP); Toshio Koike, Tokyo (JP); Mutsuki Morinaga, Kanagawa (JP); Yutaka Takahashi, Kanagawa (JP); Keinosuke Kondoh, Kanagawa (JP); Kentaro Mikuniya, Tokyo (JP); Yoshiharu Kishi, Kanagawa (JP)

(72) Inventors: Yasunobu Shimizu, Kanagawa (JP); Akira Azami, Kanagawa (JP); Masaaki Yamada, Tokyo (JP); Yoshiko Ogawa, Tokyo (JP); Toshio Koike, Tokyo (JP); Mutsuki Morinaga, Kanagawa (JP); Yutaka Takahashi, Kanagawa (JP); Keinosuke Kondoh, Kanagawa (JP); Kentaro Mikuniya, Tokyo (JP); Yoshiharu Kishi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 144 days.

(21) Appl. No.: 14/720,612

(22) Filed: May 22, 2015

(65) Prior Publication Data

US 2015/0338824 A1 Nov. 26, 2015

(30) Foreign Application Priority Data

May 22, 2014 (JP) ..... 2014-106436
Sep. 26, 2014 (JP) ..... 2014-197392
Dec. 24, 2014 (JP) ..... 2014-260761

(51) Int. Cl.
*G03G 15/09* (2006.01)
*G03G 21/16* (2006.01)
(Continued)

(52) U.S. Cl.
CPC ..... *G03G 21/1676* (2013.01); *G03G 15/0815* (2013.01); *G03G 15/095* (2013.01); *G03G 15/065* (2013.01)

(58) Field of Classification Search
CPC combination set(s) only.
See application file for complete search history.

(56) References Cited

U.S. PATENT DOCUMENTS 6,031,239 A 2/2000 Shi et al.
6,385,423 B1 5/2002 Kai
(Continued)

FOREIGN PATENT DOCUMENTS

JP S5541460 3/1980
JP S59121078 3/1980
(Continued)

*Primary Examiner* — Minh Phan
(74) *Attorney, Agent, or Firm* — Duft Bornsen & Fettig LLP

(57) ABSTRACT

A developing device includes a developer bearer to carry, by rotation, developer including toner and magnetic carrier to a developing range facing a latent image bearer; a casing including a developer container and an opening to expose a part of the developer bearer disposed in the casing; an opposing face of the casing including a conductive material and opposing to a surface of the developer bearer downstream from the developing range in a direction of rotation of the developer bearer; a developing bias source to apply a developing bias to the developer bearer; and an insulation layer disposed on the opposing face of the casing. The opposing face is disposed across, from the developer bearer,
(Continued)

a casing gap sized to allow the developer borne on the developer bearer to contact the opposing face.

15 Claims, 17 Drawing Sheets

(51) Int. Cl.

| | |
|---|---|
| ***G03G 15/08*** | (2006.01) |
| ***G03G 15/095*** | (2006.01) |
| *G03G 15/06* | (2006.01) |

(56) References Cited

U.S. PATENT DOCUMENTS

| | | | | |
|---|---|---|---|---|
| 7,925,192 | B2 | 4/2011 | Kojima et al. | |
| 7,957,681 | B2 * | 6/2011 | Shigehiro | G03G 15/0815 399/119 |
| 9,176,431 | B2 | 11/2015 | Koike et al. | |
| 2003/0161645 | A1 | 8/2003 | Azami et al. | |
| 2004/0170444 | A1 | 9/2004 | Yamada | |
| 2004/0241566 | A1 | 12/2004 | Suzuki et al. | |
| 2005/0265751 | A1 | 12/2005 | Nakazato et al. | |
| 2006/0067741 | A1 | 3/2006 | Azami | |
| 2006/0275688 | A1 | 12/2006 | Suzuki et al. | |
| 2006/0280529 | A1 | 12/2006 | Nakagawa et al. | |
| 2007/0090494 | A1 * | 4/2007 | Kimura | B21C 1/00 257/632 |
| 2010/0034557 | A1 | 2/2010 | Arai et al. | |
| 2012/0008991 | A1 | 1/2012 | Shimizu | |
| 2012/0219326 | A1 | 8/2012 | Koike et al. | |
| 2012/0237249 | A1 | 9/2012 | Utsunomiya et al. | |
| 2012/0269553 | A1 | 10/2012 | Yoshizawa et al. | |
| 2013/0071147 | A1 | 3/2013 | Ogawa et al. | |
| 2014/0090709 | A1 * | 4/2014 | Tomiyama | H01L 31/0481 136/259 |
| 2014/0112687 | A1 | 4/2014 | Ohmura et al. | |
| 2015/0037049 | A1 | 2/2015 | Shiraishi et al. | |

FOREIGN PATENT DOCUMENTS

| | | |
|---|---|---|
| JP | 63-159887 | 7/1988 |
| JP | 8-286516 | 11/1996 |
| JP | 10-012431 | 1/1998 |
| JP | 11-258907 | 9/1999 |
| JP | 2000-347506 | 12/2000 |
| JP | 2006259013 | 9/2006 |
| JP | 2009-080447 | 4/2009 |
| JP | 2009-103785 | 5/2009 |
| JP | 2009-122191 | 6/2009 |
| JP | 2009-216848 | 9/2009 |
| JP | 2010-085521 | 4/2010 |
| JP | 2011-150262 | 8/2011 |
| JP | 2012-063606 | 3/2012 |

* cited by examiner

DEVELOPING DEVICE, AND IMAGE FORMING APPARATUS AND PROCESS CARTRIDGE INCORPORATING SAME

CROSS-REFERENCE TO RELATED APPLICATIONS

This patent application is based on and claims priority pursuant to 35 U.S.C. § 119(a) to Japanese Patent Application Nos. 2014-106436 filed on May 22, 2014, 2014-197392 filed on Sep. 26, 2014, and 2014-260761 filed on Dec. 24, 2014 in the Japan Patent Office, the entire disclosure of each of which is hereby incorporated by reference herein.

BACKGROUND

Technical Field

Embodiments of the present invention generally relate to a developing device, and further relates to a process cartridge and an image forming apparatus, such as a copier, a printer, a facsimile machine, or a multifunction peripheral (or multifunction machine) having at least two of copying, printing, facsimile transmission, plotting, and scanning capabilities, that include the developing device.

Description of the Related Art

In typical developing devices, a casing includes an opening positioned in a developing range where a developer bearer faces a latent image bearer such as a photoconductor. At an entrance of the casing where the exposed surface of the developer bearer enters the casing, an airflow toward an interior of the casing (hereinafter "sucking-in airflow") is generated.

Inside the casing, developer is contained, and developing devices further include a developer conveyor (or developer agitator) to transport developer inside the casing. The developer bearer bears developer thereon. As the developer bearer rotates, the developer borne thereon is transported and passes through the developing range. At that time, toner in developer is supplied to an electrostatic latent image on the latent image bearer, and then the developer is collected in the casing.

SUMMARY

An embodiment of the present invention provides a developing device that includes a developer bearer to carry, by rotation, developer including toner and magnetic carrier to a developing range facing a latent image bearer; a casing including a developer container to contain the developer and an opening through which a part of the developer bearer disposed in the casing faces the latent image bearer; and a developing bias source to apply a developing bias to the developer bearer; an opposing face including a conductive material and provided to the casing opposing to a surface of the developer bearer downstream from the developing range in a direction of rotation of the developer bearer; and an insulation layer disposed on the opposing face of the casing. The opposing face is disposed across a casing gap from the developer bearer, and the casing gap is sized to allow the developer borne on the developer bearer to contact the opposing face of the casing.

In another embodiment, an image forming apparatus includes the latent image bearer, a charging device to charge the surface of the latent image bearer, and the above-described developing device to develop an electrostatic latent image on the latent image bearer.

In yet another embodiment, a process cartridge removably installed in an image forming apparatus includes the latent image bearer, the above-described developing device, and a common unit casing to hold the latent image bearer and the developing device as a single unit.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
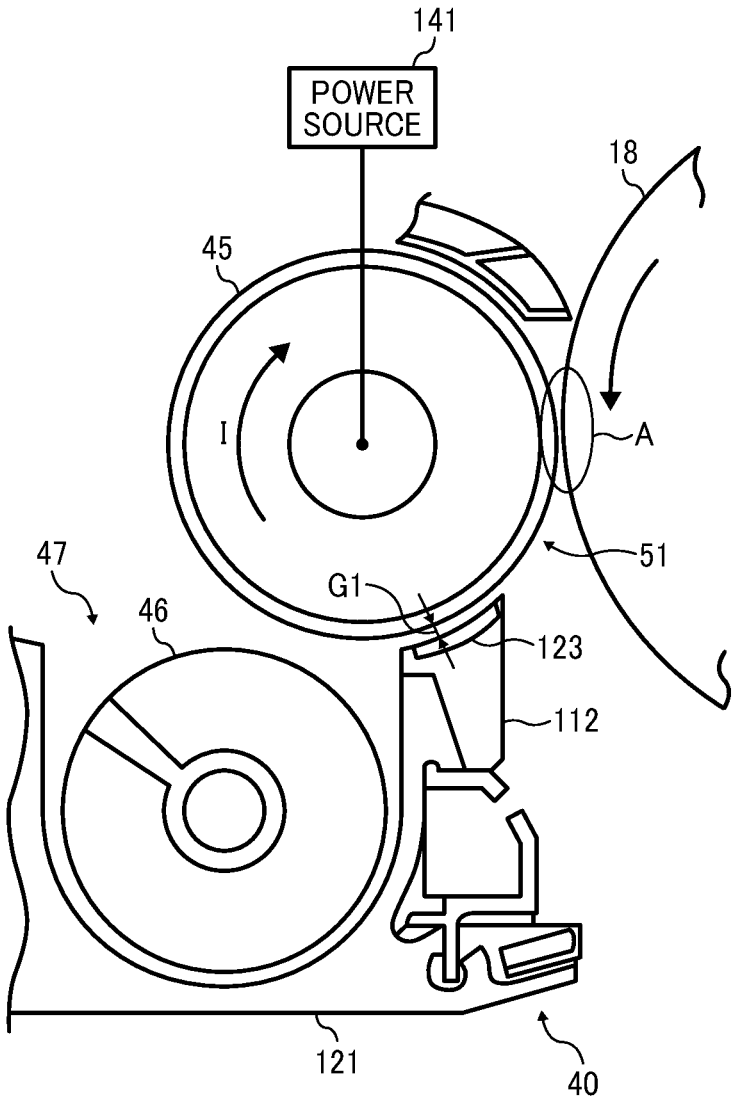
FIG. 1 is an enlarged view around a developing roller of a developing device according to a first embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, developing devices according to an embodiment of the present invention is described.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

First Embodiment

Initially, a multicolor image forming apparatus including a developing device according to a first embodiment is described below with reference to FIG. 2.

Figure 2:
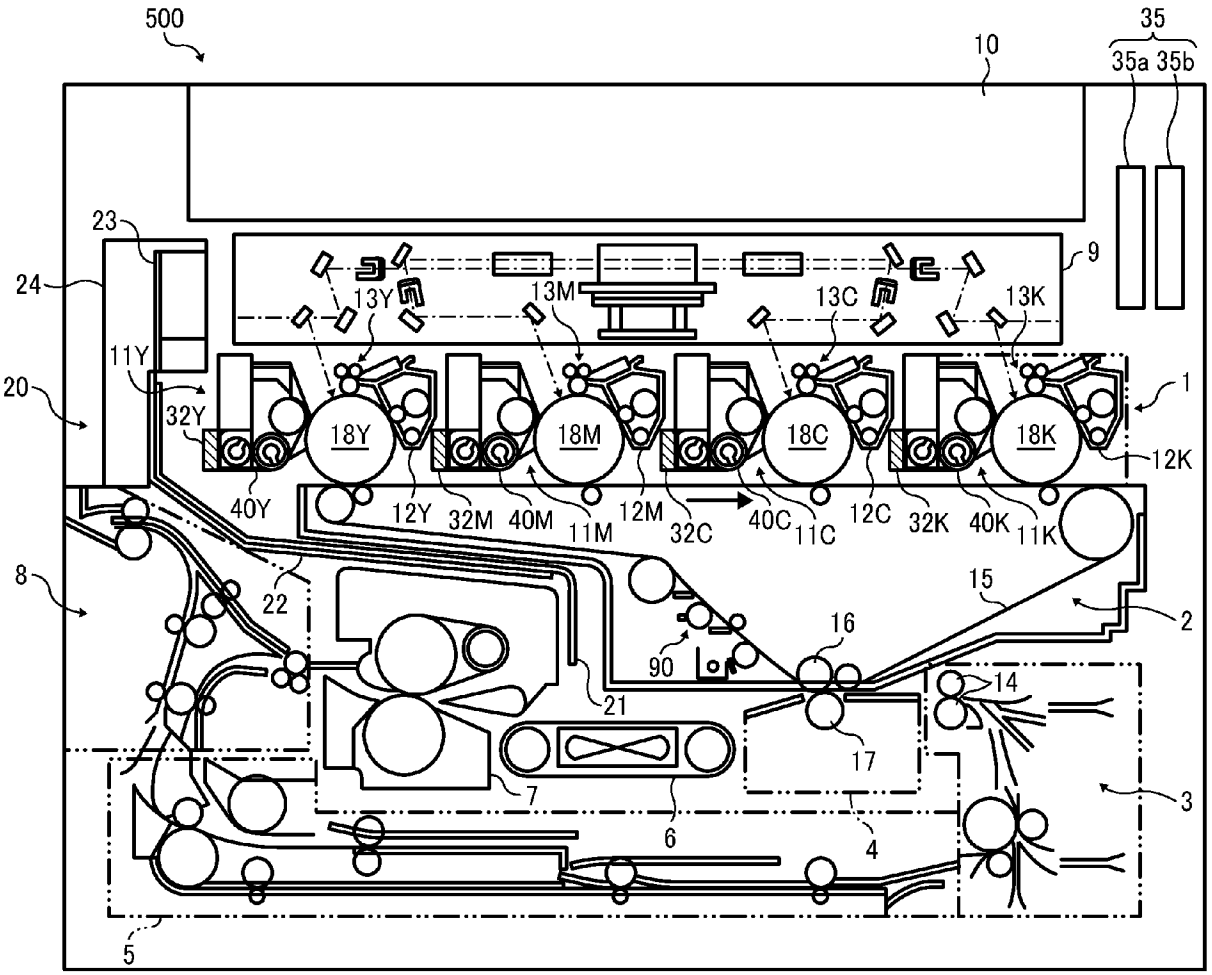
FIG. 2 is a schematic view illustrating an image forming apparatus according to an embodiment.

FIG. 2 is a schematic diagram that illustrates a configuration of an image forming apparatus 500 according to the present embodiment. For example, the image forming apparatus 500 is a copier.

The image forming apparatus 500 illustrated in FIG. 2 includes a tandem image forming unit 1 in which four image forming units 11Y, 11M, 11C, and 11K are arranged in parallel to each other. Each image forming unit 11 includes a drum-shaped photoconductor 18 serving as a latent image bearer, a drum cleaning unit 12, a charging device 13, and a developing device 40. The developing device 40 employs two-component development and contains two-component developer including toner and carrier.

These components are housed in a common unit casing 110 (illustrated in FIG. 11), and the image forming unit 11 is configured as a process cartridge (i.e., a modular unit) removably installable in an apparatus body of the image forming apparatus 500. Thus, multiple consumables can be replaced at a time.

An exposure device 9 serving as a latent image forming unit is provided above the tandem image forming unit 1. A scanner 10 (i.e., a reading device) is provided in an upper portion of the apparatus. The scanner 10 scans a document placed on an exposure glass, thereby reading image data of the document. Beneath the tandem image forming unit 1, a primary transfer unit 2 including an intermediate transfer belt 15 serving as an intermediate transfer member is provided. The intermediate transfer belt 15 is looped around multiple rollers including a support roller 16 and rotates clockwise in FIG. 2. Beneath the primary transfer unit 2, a secondary transfer device 4 is provided.

The secondary transfer device 4 includes a secondary transfer roller 17 disposed in contact with an outer side of the intermediate transfer belt 15 and pressing against the support roller 16 via the intermediate transfer belt 15. A nip between the secondary transfer roller 17 and the intermediate transfer belt 15 is called "secondary transfer nip".

A secondary transfer bias is applied to the secondary transfer roller 17 from a power source, and the support roller 16 is electrically grounded. Thus, a secondary transfer electrical field is generated in the secondary transfer nip. A fixing device 7 is provided on the left of the secondary transfer device 4 in FIG. 2 to fix toner images on sheets of recording media. The fixing device 7 includes a hearing roller inside which a heat generator is provided.

A conveyance belt 6 is provided between the secondary transfer device 4 and the fixing device 7 to transport the sheet onto which a toner image is transferred to the fixing device 7. The image forming apparatus 500 further includes a sheet feeder 3 disposed in a lower right portion of the apparatus for feeding sheets from a sheet container (i.e., a sheet tray) one by one to the secondary transfer device 4. Further, a sheet reversal unit 5 is disposed in a lower portion of the image forming apparatus 500 to transport the sheet bearing a fixed toner image on a front side thereof again to the sheet feeder 3. An ejection unit 8 disposed on the left of the fixing device 7 in FIG. 2 transports the sheet that has passed through the fixing device 7 either outside the apparatus or to the sheet reversal unit 5.

To make copies of documents in the image forming apparatus 500, image data of the documents is read with the scanner 10. In parallel to image reading, the intermediate transfer belt 15 rotates clockwise in FIG. 2. Further, the charging devices 13 electrically charge the respective surfaces of the photoconductors 18 in the tandem image forming unit 1. The exposure device 9 exposes the photoconductors 18 according to yellow, magenta, cyan, and black image data of the document, thus forming latent images on the respective photoconductors 18.

Subsequently, the developing devices 40 develop the respective latent images on the photoconductors 18 with developer (e.g., toner) into single-color toner images. The toner images are sequentially transferred from the photoconductors 18 and superimposed on one another on the intermediate transfer belt 15. Thus, a multicolor toner image (i.e., a synthesized image) is formed on the intermediate transfer belt 15.

After a primary transfer process, the drum cleaning units 12 remove toner remaining on the photoconductors 18 as a preparation for subsequent image formation.

In parallel to toner image formation, sheets are fed from the sheet container one at a time. The sheet gets stuck in a nip between registration rollers 14 and is stopped. The registration rollers 14 then rotate to send the sheet to the secondary transfer nip, where the intermediate transfer belt 15 presses against the secondary transfer device 4, timed to coincide with the multicolor toner image formed on the intermediate transfer belt 15. In the secondary transfer nip, the multicolor toner image is transferred by the secondary transfer device 4 from the intermediate transfer belt 15 onto a first side (e.g., a front side) of the sheet (i.e., a secondary transfer process). After the secondary transfer process, the conveyance belt 6 transports the sheet to the fixing device 7, where the toner image is fixed on the sheet with heat and pressure (i.e., a fixing process), after which the sheet is transported to the ejection unit 8.

The ejection unit 8 includes a switching pawl to switch the destination of the sheet between an output tray provided outside the apparatus (on the left in FIG. 2) and the sheet reversal unit 5 in the lower portion of the apparatus. The sheet is reversed in the sheet reversal unit 5 and again transported to the secondary transfer nip (secondary transfer position) to form an image on a second side of the sheet. Then, the ejection unit 8 ejects the sheet to the output tray.

Meanwhile, a belt cleaning unit 90 removes toner remaining on the intermediate transfer belt 15 after the image is transferred therefrom in preparation for subsequent image formation.

To make the image forming apparatus 500 compact, in the configuration illustrated in FIG. 2, the components are densely packed inside the apparatus. For example, the fixing device 7 is disposed beneath the primary transfer unit 2, the lateral length of which is relatively long. Accordingly, in the configuration illustrated in FIG. 2, the intermediate transfer belt 15 is curved to cover the upper side and the right side of the fixing device 7. This arrangement can reduce the height and the width of the apparatus.

However, in the arrangement in which the fixing device 7 to generate heat is adjacent to the intermediate transfer belt 15, it is possible that the fixing device 7 thermally affects and causes the intermediate transfer belt 15 to deform, resulting in image failure such as misalignment in superposition of different color images (out of color registration). As image formation speed increases and the amount of heat generated therein increases, such adverse effects become significant.

Further, in duplex printing, the sheet once heated by the fixing device 7 passes through the sheet reversal unit 5 and again contacts the intermediate transfer belt 15 at the secondary transfer position. Accordingly, heat is transmitted from the sheet, and temperature of the intermediate transfer belt 15 further rises. Moreover, the heat can be transmitted also to the photoconductors 18 in contact with the intermediate transfer belt 15 and further to the developing devices 40, thus increasing the possibility of occurrence of deformation of the intermediate transfer belt 15, solidification of toner, and resultant image failure.

In view of the foregoing, an insulation device 20 is provided between the fixing device 7 that is a heat generator and the intermediate transfer belt 15 adjacent to the fixing device 7 to thermally insulate them from each other. Although the insulation device 20 in the present embodiment uses a heat pipe, an insulation device using a duct to generate a cooling airflow is used in another embodiment. The insulation device 20 includes a planar heat receiver 21, a heat pipe 22, a planar radiator 23, a duct 24, and an exhaust fan.

The planar heat receiver 21 is made of or includes a material to absorb heat easily and disposed between the heat generator, namely, the fixing device 7, and an object to be protected from heat, namely, the primary transfer unit 2. The heat pipe 22 serves as a heat transmitter (heat transport member) and is attached to a lower face of the planar heat receiver 21. A first end portion (lower portion in FIG. 2) of the heat pipe 22 serves as a heat receiving portion. A second end portion (upper end portion in FIG. 2) of the heat pipe 22 serves as a heat radiating portion and is attached to the radiator 23 at a position higher than the heat receiving portion. The radiator 23 is made of or includes a material capable of releasing heat easily. Further, a heatsink may be provided as required.

In the configuration illustrated in FIG. 2, the duct 24 extends from the front side to the back side of the image forming apparatus 500, and the radiator 23 is disposed inside the duct 24. An air inlet and an exhaust outlet are provided at first and second ends of the duct 24 on the front side and back side of the apparatus, respectively. The exhaust fan is provided in the exhaust outlet on the back side of the apparatus.

In the insulation device 20 configured as described above, the planar heat receiver 21 receives heat from the heat generator (the fixing device 7 in the present embodiment), and the heat is transmitted through the heat pipe 22 to the heat radiating portion (the radiator 23). Then, the heat is released from the radiator 23 provided in the duct 24 and is discharged outside the apparatus by the exhaust fan. It is to be noted that, alternatively, the heat may be subjected to natural cooling without providing the exhaust fan.

Thus, the protected objects, namely, the image forming units 11 and the primary transfer unit 2 are thermally insulated from the heat generated in image fixing and protected effectively. Accordingly, out of color registration caused by deformation of the intermediate transfer belt 15, solidification of toner, and resultant inconveniences can be eliminated or reduced.

Additionally, developing devices typically include a developer conveyor such as a screw, a coil, and a paddle, to transport developer (e.g., toner) therein, a developer bearer to carry developer thereon, and a developer regulator to adjust the amount of developer carried on the developer bearer. For example, Heat can be generated by sliding contact between developer and the developer conveyor as well as contact among developer particles, and temperature inside the developing device rises.

The temperature inside the developing device can rise also due to sliding contact between developer and the developer regulator to adjust the amount of developer carried on the developer bearer and contact among developer particles being regulated by the developer regulator.

When the temperature inside the developing device rises beyond a certain point, the amount of charge of toner can decrease, and the amount of toner adhering increases. Then, it becomes difficult to maintain desired image density. Moreover, the temperature rise can fuse toner and cause the toner to adhere to the developer regulator. The toner adhering to the developer regulator can create lines in output images, degrading image quality.

Possibility of image failure caused by adhesion of toner is typically higher when toner having a lower melting temperature is used to reduce energy required for image fixing. Additionally, the temperature of the developing device tends to increase due to increases in image formation speed.

Therefore, to attain high image quality and secure reliability, the developing device is cooled. To restrict the temperature rise in the developing device, airflow may be generated around the developing device using an air-cooling fan.

However, in response to demands for compactness of the apparatus, the space for installing the air duct to generate airflow around the developing device is reduced. If the air duct becomes smaller, the amount of air flowing around the developing device decreases accordingly, which can prevent sufficient cooling of the developing device. Therefore, in the present embodiment, liquid cooling is used to cool the developing devices 40.

Figure 3:
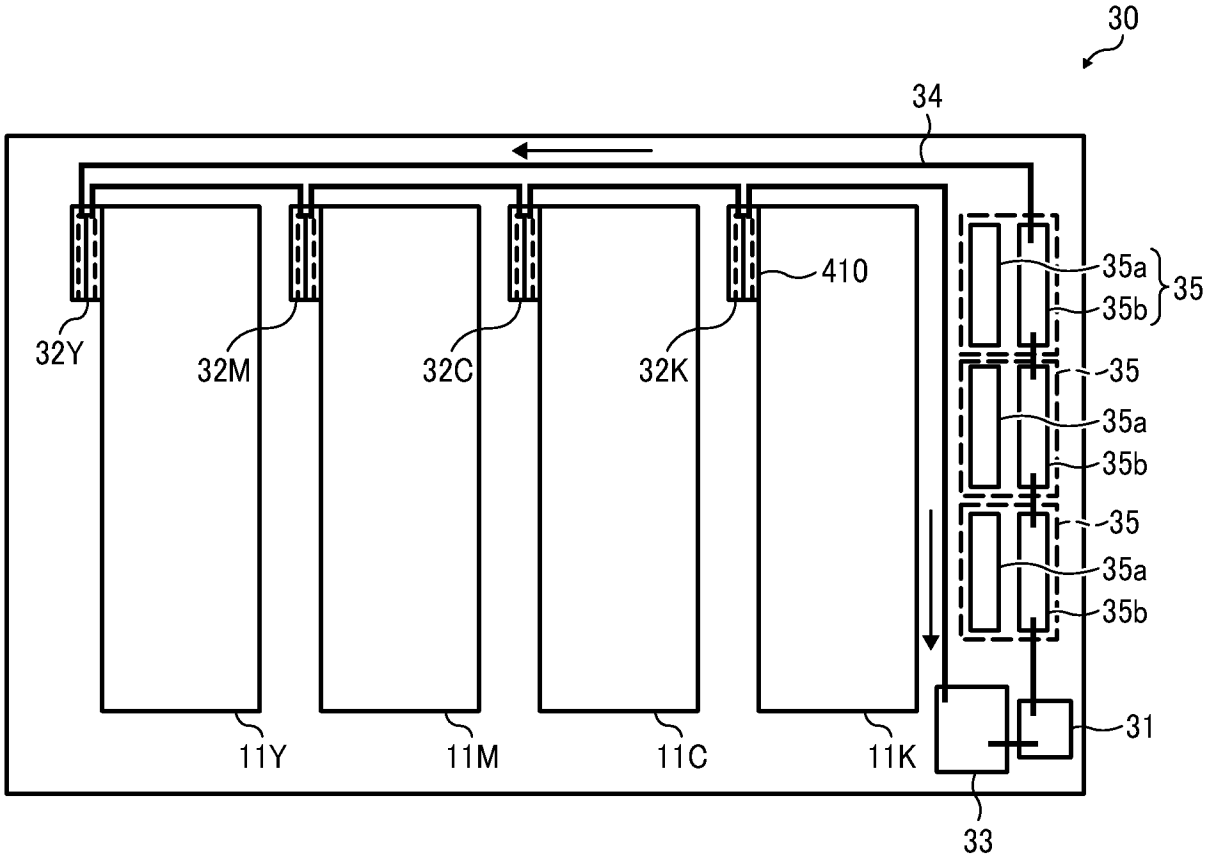
FIG. 3 is a schematic view of a liquid-cooling device according to the first embodiment.

FIG. 3 is a schematic diagram illustrating a liquid-cooling device 30 according to the present embodiment.

As illustrated in FIG. 3, the liquid-cooling device 30 includes four heat receivers 32Y, 32M, 32C, and 32K, three cooling units 35, a circulation pipe 34 to contain coolant, a cooling pump 31 to transport and circulate coolant inside the circulation pipe 34, and a reserve tank 33 to contain coolant. Each of the heat receivers 32Y, 32M, 32C, and 32K is pressed against a side wall 410 of a casing of the developing device 40, which is a hot portion. The coolant in the heat receivers 32Y, 32M, 32C, and 32K draws heat from the developing devices 40Y, 40M, 40C, and 40K, after which the cooling units 35 cool the coolant. Coolant is circulated through the circulation pipe 34. Each cooling units 35 includes a radiator 35*b* and a cooling fan 35*a*.

The heat receiver 32 includes a case 32*a* in which a coolant channel 32*b* (in FIG. 4) is disposed. The case 32*a* and the coolant channel 32*b* are made of a material having high thermal conductivity. Typically, copper having a thermal conductivity of about 400 W/m·K or aluminum having a thermal conductivity of about 200 W/m·K is used as a base of the case 32*a* of the heat receiver 32. Alternatively, materials having higher thermal conductivity such as copper, silver, or gold may be used.

Additionally, in one embodiment, to enhance heat conduction, the side wall 410 of the casing of the developing device 40 is made of aluminum. In such a case, it is difficult to dispose the heat receiver 32 in tight contact with the side wall 410 of the developing device 40, and creation of an air layer is inevitable. Air layers are not desirable because efficiency in heat exchange is degraded.

In view of the foregoing, in the present embodiment, a heat conduction sheet 130 (illustrated in FIG. 4) is attached to a face of the heat receiver 32 facing the developing device 40. It is advantageous that the heat conduction sheet 130 has a high thermal conductivity while deformable in conformity with surface irregularities of the developing device 40 and the heat receiver 32, thereby eliminating clearances therebetween. Hardness of heat conduction sheets, however, is proportional to its thermal conductivity, and the heat conduction sheet 130 inevitably becomes relatively hard to attain high thermal conductivity.

Therefore, in the present embodiment, the heat receiver 32 is pressed against the side wall 410 of the developing device 40 with a relatively strong force. With this configuration, the heat conduction sheet 130 deforms to cancel out the surface irregularities between the developing device 40 and the heat receiver 32 even if the hardness thereof is relatively high. Thus, creation of air layers between the developing device 40 and the heat receiver 32 can be inhibited, thereby reliably transmitting heat from the developing device 40 to the heat receiver 32. It is to be noted that the heat conduction sheet 130 may be attached to the side wall 410 of the developing device 40.

Referring to FIG. 3, in the cooling unit 35, the radiator 35*b* transmits and releases heat from the coolant via a container containing the coolant. The container is made of a material, such as aluminum, that is high in thermal conductivity. Depending on the amount of heat released from the radiator 35*b*, heat is released by either forced air-cooling using the cooling fan 35*a* or natural cooling. It is to be noted that the number of the cooling units 35 is not limited to three but can be less or greater than three. Additionally, although each cooling unit 35 includes one cooling fan 35*a*, alternatively, a single common cooling fan may be used to supply external air to the radiators 35*b* of the multiple cooling unit 35.

Use of the multiple cooling units 35 is advantageous in reliably suppressing temperature rise in the four developing devices 40 even when the cooling efficiency of the individual cooling unit 35 is relatively low. As a result, small radiators having a smaller heat-releasing area and lower cooling efficiency can be used, making the cooling unit 35 more compact, compared with a configuration in which only a single cooling unit is used for the four developing devices 40.

The cooling pump 31 is a driving source to circulate the coolant between the heat receivers 32Y, 32M, 32C, and 32K and the cooling units 35 as indicated by arrows illustrated in FIG. 3. The reserve tank 33 is used to store the coolant. Coolant is a heat transport medium to transport heat from the heat receivers 32Y, 32M, 32C, and 32K to the radiators 35*b*. The coolant used here includes water as a main ingredient and may further include an additive, such as propylene glycol or ethylene glycol, to lower the freezing temperature and antirust. Examples of antirust include phosphate such as potassium phosphate salt and inorganic salt of potassium.

Use of water is advantageous in transporting a large amount of heat with a small amount of coolant because a heat capacity at constant volume of water is 3000 times greater than that of air. Thus, water can attain more efficient cooling compared with forced air-cooling.

Figure 4:
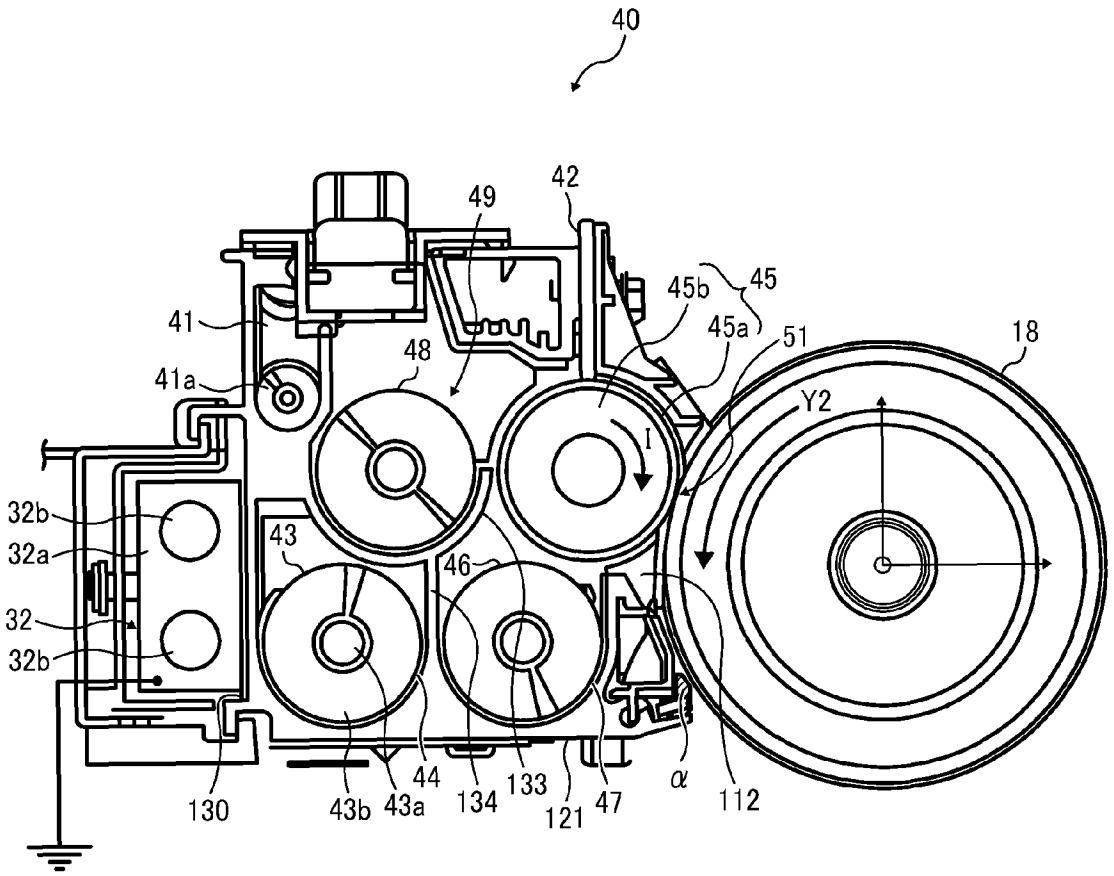
FIG. 4 is an enlarged view of a developing device according to the first embodiment.
Figure 5:
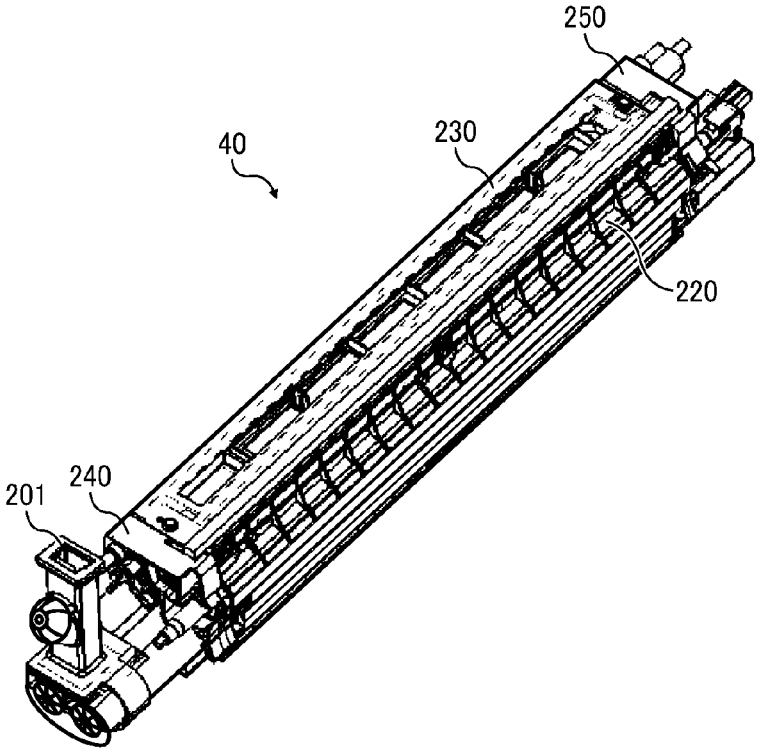
FIG. 5 is a perspective view of the developing device illustrated in FIG. 4, as viewed from above.
Figure 6:
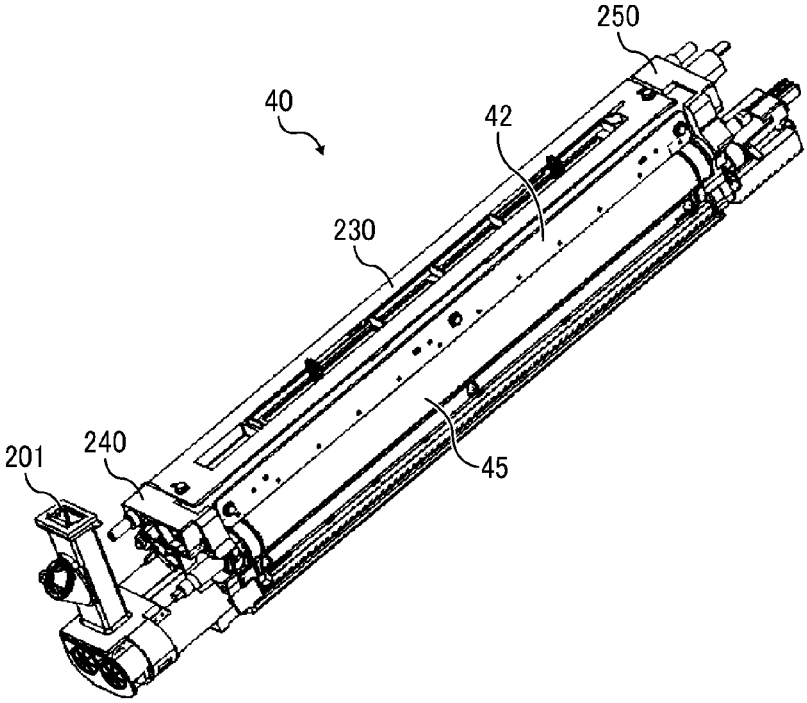
FIG. 6 is a perspective view of the developing device illustrated in FIG. 5, from which an upper roller cover is removed.

FIG. 4 is an enlarged end-on axial view illustrating the developing device 40 and the photoconductor 18 of each image forming unit 11 illustrated in FIG. 2. FIG. 5 is a perspective view of the developing device 40 as viewed from above, and FIG. 6 is a perspective view of the developing device 40 without an upper roller cover 220 to cover an upper portion of a developing roller 45.

The four image forming units 11Y, 11M, 11C, and 11K have a similar configuration except the color of toner used therein, and the subscripts Y, M, C, and K attached to the end of reference numerals are omitted in FIG. 4 and subsequent drawings.

Referring to FIGS. 2 and 4, while the photoconductor 18 rotates in the direction indicated by arrow Y2 in FIG. 4, the charging device 13 (in FIG. 2) charges the surface of the photoconductor 18, and an electrostatic latent image is formed thereon with the laser light emitted from the exposure device 9. Then, the developing device 40 supplies the latent image with toner, forming a toner image.

The developing device 40 includes a casing body 121 that includes a developer container (i.e., partitioned developer containing compartments) and contains the developing roller 45 serving as a developer bearer. The developing roller 45 supplies toner to an electrostatic latent image on the photoconductor 18 while rotating in the direction indicated by arrow I in FIG. 4. The developing roller 45 includes a rotatable developing sleeve 45*a* and a magnet roller 45*b* serving as a magnetic field generator, disposed inside the developing sleeve 45*a*. The magnet roller 45*b* has multiple magnetic poles.

The developing device 40 further includes a supply screw 48 that transports developer in an axial direction of the developing roller 45, from a back side to a front side of the paper on which FIG. 4 is drawn, while supplying developer to the developing roller 45. Additionally, a doctor blade 42, serving as a developer regulator, that adjusts the amount of developer supplied to the developing roller 45 is positioned downstream from a supply portion where the developing roller 45 faces the supply screw 48 in the direction indicated by arrow I (hereinafter "direction I") in which the developing roller 45 rotates.

The developing roller 45 faces a collecting channel 47 at a position downstream in the direction I, in which the developing roller 45 rotates, from a developing range where the developing roller 45 faces the photoconductor 18. The developer that has passed through the developing range and left the developing roller 45 is collected in the collecting channel 47. The collecting channel 47 includes a collecting screw 46 disposed parallel to the axial direction of the developing roller 45. The collecting screw 46 transports developer along the axial direction of the developing roller 45 and identical or similar to the direction in which the supply screw 48 transports the developer (hereinafter "developer conveyance direction"). The developing roller 45 and a supply channel 49, in which the supply screw 48 is disposed, are arranged laterally. The collecting channel 47, in which the collecting screw 46 is disposed, is positioned beneath the developing roller 45.

It is to be noted that the magnet roller 45*b* inside the developing sleeve 45*a* is configured not to have a magnetic pole in a release portion facing the collecting channel 47 to enable separation of the developer from the developing roller 45. Alternatively, the magnet roller 45*b* may be configured to generate a repulsive magnetic field in the release portion to separate developer from the developing roller 45.

The developing device 40 further includes an agitation channel 44 positioned beneath the supply channel 49 and on a side of the collecting channel 47. An agitation screw 43 is disposed in the agitation channel 44 to transport developer in the axial direction of the developing roller 45 while stirring the developer. The agitation screw 43 extends parallel to the axial direction of the developing roller 45 and transports developer in the agitation channel 44 from the proximal side to the distal side in FIG. 4, which is opposite the direction in which the supply screw 48 transports developer. The agitation screw 43 includes a shaft 43*a* and a spiral blade 43*b* attached to the shaft 43*a*.

A first partition 133 separates, at least partly, the supply channel 49 from the agitation channel 44. Although separated by the first partition 133, the supply channel 49 and the agitation channel 44 communicate with each other in both axial end portions, which are respectively on the front side (an openings 92 in FIG. 7) and the back side (an opening 91 in FIG. 7) of the paper on which FIG. 4 is drawn.

It is to be noted that the supply channel 49 and the collecting channel 47 are separated by the first partition 133 as well, and no opening is in that portion of the first partition 133. Thus, the supply channel 49 does not communicate with the collecting channel 47.

Additionally, a second partition 134 that includes a portion separating the agitation channel 44 from the collecting channel 47 is provided. Although partly separated by the second partition 134, the agitation channel 44 communicates with the collecting channel 47 through an opening 93 (in FIG. 7, serving as a communication portion) positioned at an axial end on the front side of the paper on which FIG. 4 is drawn.

In the present embodiment, for example, the supply screw 48, the collecting screw 46, and the agitation screw 43, serving as developer conveyors, are made of resin or metal and have a diameter of about 22 mm. For example, the supply screw 48 is double threaded and has a screw pitch of about 50 mm, and the collecting screw 46 and the agitation screw 43 are single threaded and have a screw patch of about 25 mm. The rotation speed of these screws are set at about 600 revolutions per minute (rpm), in one embodiment. Additionally, for example, the agitation channel 44 has a length of about 410 mm, and the supply channel 49 has a length of about 320 mm.

The developer carried on the developing roller 45 is regulated into a thin layer by the doctor blade 42 and conveyed to the developing range facing the photoconductor 18 for image development. The doctor blade 42 is made of or includes metal such as stainless steel and disposed above the developing roller 45 in FIG. 4, in one embodiment. An aluminum (Al) base pile or a stainless steel (SUS or Steel Use Stainless) having a diameter of about 25 mm is used for the developing roller 45. The surface of the developing roller 45 has V-shaped grooves. Alternatively, the surface of the developing roller 45 may be sandblasted. A regulation gap, which is between the doctor blade 42 and the photoconductor 18, and a development gap, which is between the developing roller 45 and the photoconductor 18, are about 0.3 mm in one embodiment.

After being used in image development, developer is collected in the collecting channel 47 and then is conveyed to the front side of the paper on which FIG. 4 is drawn. The collected developer is further conveyed, through the opening 93 (in FIG. 7) in the second partition 134 situated in a non-image area, to the agitation channel 44.

Beneath the agitation channel 44, a toner density sensor is disposed to detect density of toner (or concentration of toner in developer). According to detection results generated by the toner density sensor, a toner supply device is activated, and toner is supplied to the agitation channel 44 through a toner supply inlet 201 (in FIG. 5) situated on an upper wall of the agitation channel 44, close to the opening 93 in the second partition 134.

It is to be noted that the casing body 121 of the developing device 40 includes the agitation channel 44, the collecting channel 47, and the supply channel 49 serving as developer container. The casing body 121 includes an opening 51 to expose a part of the surface of the developing roller 45 in the direction I of rotation thereof, and the exposed portions of the developing roller 45 opposes to the photoconductor 18.

Figure 7:
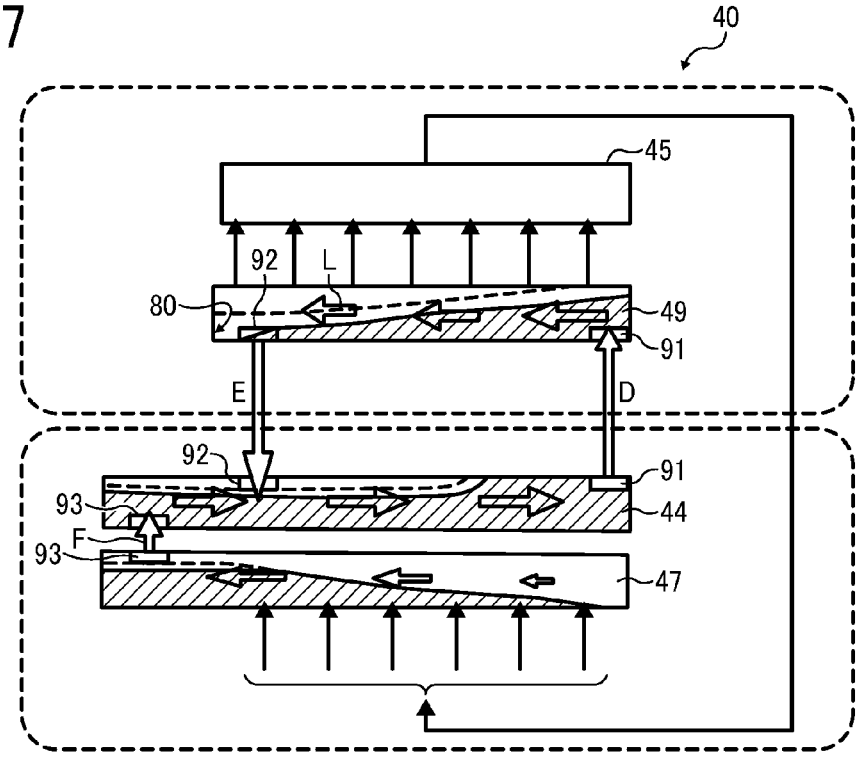
FIG. 7 illustrates flow of developer in the developing device illustrated in FIG. 4.

FIG. 7 is a schematic view that illustrates flow of developer inside the developing device 40, and arrows D, E, F, and L in FIG. 7 represent directions of movement of developer.

Referring to FIGS. 4 and 7, in the supply channel 49, the supply screw 48 transports the developer supplied from the agitation channel 44 in the direction indicated by arrow L while supplying the developer to the developing roller 45. The developer that is not supplied to the developing roller 45 but is transported to a downstream end 80 of the supply channel 49 (excessive developer) is transported through the opening 92 in the first partition 133 to the agitation channel 44 as indicated by arrow E.

The developer supplied to the developing roller 45 and used in image development in the developing range is collected to the collecting channel 47. The developer collected in the collecting channel 47 is transported by the collecting screw 46 to the downstream end of the collecting channel 47 in the conveyance direction therein, after which the developer is transported to the agitation channel 44 through the opening 93 (i.e., a communication portion) as indicated by arrow F in FIG. 7.

In the agitation channel 44, the excessive developer and the collected developer are mixed together and transported by the agitation screw 43. Then, the developer is transported through the opening 91 in the first partition 133 to the supply channel 49 as indicated by arrow D in FIG. 7.

In the agitation channel 44, the agitation screw 43 transports the collected developer and the excessive developer, together with toner supplied through the toner supply inlet 201, in the direction opposite the direction in which developer is transported in the collecting channel 47 and the supply channel 49. Subsequently, the developer is transported to the upstream end of the supply channel 49 through the opening 91.

In the developing device 40 illustrated in FIG. 7, the used developer does not directly enter the supply channel 49 because supply and collection of developer are performed separately in the supply channel 49 and the collecting channel 47. Therefore, decreases in toner concentration in developer supplied to the developing roller 45 on the downstream side in the supply channel 49 can be prevented or reduced.

Additionally, since collection and agitation of developer are performed in different developer channels, namely, the collecting channel 47 and the agitation channel 44, the used developer is inhibited from being supplied to the developing roller 45 during agitation. Therefore, only sufficiently agitated developer is allowed to enter the supply channel 49. In other words, decreases in concentration of toner in the developer in the supply channel 49 is alleviated, and accordingly image density is kept constant.

In the developing device 40 according to the present embodiment, after carried through the developing range by the developing roller 45, developer is transported by the collecting screw 46 and the agitation screw 43 and then pushed up from the agitation channel 44 to the supply channel 49.

As illustrated in FIG. 7, upward movement of developer in the developing device 40 is limited to the movement indicated by arrow D in FIG. 7. As the agitation screw 43 rotates, developer is pressed to the downstream side of the agitation channel 44 and is piled up, and accordingly the developer is transported upward to the supply channel 49 as indicated by arrow D in FIG. 7.

In another embodiment, a fin is provided to the shaft 43*a* of the agitation screw 43 positioned in the opening 91 where the agitation channel 44 communicates with the supply channel 49, which is adjacent to the downstream end in the developer conveyance direction in the agitation channel 44. The fin is planar and includes sides parallel to the axial direction of the agitation screw 43 and sides perpendicular to the axial direction of the agitation screw 43. By agitating up the developer with the fin, the developer can be transported more efficiently from the agitation channel 44 to the supply channel 49.

Additionally, a discharge channel 41 (in FIG. 4) communicates with the supply channel 49 via an outlet disposed adjacent to the upstream end of the supply channel 49 in the developer conveyance direction therein. When the amount of developer at the upstream end of the supply channel 49 exceeds a given amount, the developer is piled up to the height of the outlet, and flows through the outlet to the discharge channel 41.

A discharge screw 41*a* is disposed in the discharge channel 41 to transport the developer to a developer container disposed outside the developing device 40. By discharging developer, the developing device 40 keeps the amount of developer therein constant.

In another embodiment in which premixed toner, in which carrier is mixed, is supplied to the developing device 40, degraded carrier is discharged to the discharge channel 41 together with toner. Since carrier is thus replaced, degradation of developer in the developing device 40 is inhibited.

Figure 8:
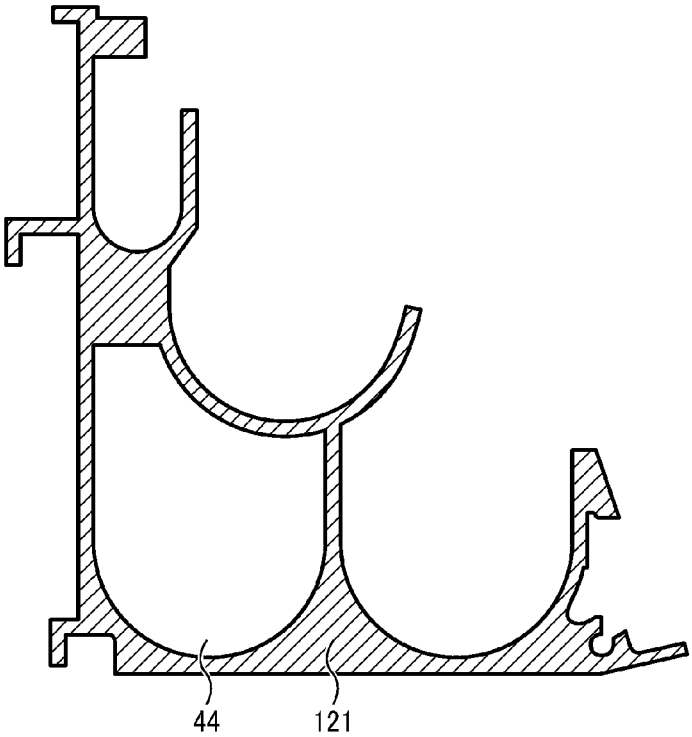
FIG. 8 is a cross-sectional view of a casing body of the developing device illustrated in FIG. 4, in which three developer conveyance channels are defined.

FIG. 8 is a cross-sectional view of the casing body 121 of the developing device 40.

As illustrated in FIGS. 4, 5, and 6, the developing device 40 includes the casing body 121, a channel upper cover 230, the upper roller cover 220, a front end plate 240, and a back end plate 250, which in combination serve as the casing (i.e., a developing device casing) of the developing device 40 to contain developer. The developing device casing serves as the developer container and includes walls to enclose the agitation channel 44, the collecting channel 47, and the supply channel 49 (hereinafter collectively "developer conveyance channels").

The developing device 40 includes the three conveying screws to stir and transport developer in the three developer conveyance channels. The developing roller 45 transports developer to the developing range in which the developing roller 45 is closest to the photoconductor 18.

The developing sleeve 45*a* carries developer thereon with magnetic force exerted by the magnet roller 45*b*. While being agitated, the magnetic carrier and toner in developer are charged in the opposite polarities and attracted to each other with electrostatic force generated by the charging. The magnetic carrier is carried on the developing roller 45 by magnetic force, and toner adheres to the magnetic carrier by electrostatic force. Thus, a layer of developer in the shape of magnetic brush is carried on the developing roller 45.

The developer layer on the developing roller 45, leveled off by the doctor blade 42, is transported to the developing range as the developing roller 45 rotates. Toner in developer is transferred to the photoconductor 18 by a developing electrical field due to potential differences between the developing roller 45 to which the developing bias is applied and the surface of the photoconductor 18 bearing the latent image.

Subsequently, developer is collected in the developing device casing, circulated in the developer conveyance channels together with toner supplied from the toner supply inlet 201, and again used in image developing.

In a longitudinal direction or the axial direction of the developing roller 45, the developing device casing is equal to or longer than a printable range width on recording media.

As illustrated in FIGS. 5 and 6, the front end plate 240 and the back end plate 250, which are parts of the developing device casing, support both axial ends of each of the casing body 121, the developing roller 45, and the shaft of each of the three developer conveying screws. Additionally, the channel upper cover 230 is secured to the casing body 121 to cover an upper side of the casing body 121 and enclose the supply channel 49. The doctor blade 42 is secured to the channel upper cover 230. The upper roller cover 220 covers a surface of the developing roller 45 closer to the developing range than the doctor blade 42.

In the casing body 121, the supply channel 49, the collecting channel 47, and the agitation channel 44 are partitioned from each other in portions except the openings 91, 92, and 93, and these developer conveyance channels have an axial length equal to or greater than a width of sheets of recording media. For example, the casing body 121 has an axial length of about 297 mm or greater in the developing device 40 used for image formation on A3 size sheets.

Thus, the casing body 121 is relatively long in the axial direction, and a cross-sectional shape thereof (illustrated in FIG. 8) is identical or substantially identical over the axial direction. Additionally, in the present embodiment, the agitation channel 44 is tubular and enclosed by wall faces of the casing body 121 as illustrated in FIG. 8. It may be difficult to produce the casing body 121 having such a shape as a single plastic part by injection molding.

It is conceivable to weld two molded plastic parts into the above-described shape. However, the following inconveniences may arise in high-end image forming apparatus capable of high quality image formation at high speed, such as, forming images on 60 sheets or greater per minute in the case of A4 size.

Specifically, in such a high-end apparatus, typically the amount of two component developer contained in a single developing device is about 400 grams to 800 grams. When the casing body 121 to contain this amount of developer is made of plastic, it is possible that the casing body 121 is charged up by electrical charges of charged developer, inducing image failure.

For example, toner circulating inside the casing body 121 may be attracted to the wall face of the charged casing body 121, resulting in adhesion of toner thereto. When toner adhering to the casing body 121 falls therefrom and used in image developing, spots appear in images, or toner is partly absent in images like white dots.

Additionally, in the configuration in which the intermediate transfer belt 15 is situated beneath the developing device 40 as illustrated in FIG. 2, it is possible electrical force acts between the charged casing body 121 and the toner image on the intermediate transfer belt 15. Such electrical force can induce an electrical phenomenon, such as electrical discharge, and disturb the toner image, resulting in dust particles in the image or fading of the image.

To suppress such inconveniences, the developing device 40 according to the present embodiment uses an extruded aluminum product as the casing body 121. Use of an extruded product is advantageous in keeping the cross-sectional shape uniform in the longitudinal direction in the casing body 121, which includes a relatively long tubular portion. Use of metal such as aluminum as a material of the casing body 121 is advantageous since the casing body 121 can be electrically continuous with the apparatus body and grounded, thereby inhibiting inconveniences arising from charging-up of the casing body 121.

Use of metal for the casing body 121 is also advantageous in efficiently transmitting heat from developer through the casing body 121 to the heat receiver 32 of the liquid-cooling device 30.

The surface of the developing roller 45 is exposed in the developing range via the opening 51, and accordingly the developer borne thereon is temporarily transported outside the developing device casing. Developer is borne on the developing roller 45 with magnetic force and electrostatic force and collected inside the developing device 40 after passing through the developing range. Since the developing sleeve 45*a* rotates, it is possible that a part of developer whose charge is weak (i.e., insufficiently charged toner) is separated from the developing roller 45 and scattered by centrifugal force thereof.

If the amount of scattering toner increases, it is possible that the exterior and the interior of the image forming apparatus 500 are smeared with developer, or malfunction of other portions is caused. Additionally, if scattering developer accumulates in or around an area α in FIG. 4 downstream from the developing range in the direction of rotation of the developing sleeve 45*a*, it is possible that the developer falls from the area α on the image, resulting in substandard images including spots or white dots.

To suppress scattering of developer, it is advantageous to generate an airflow flowing into the developing device 40 (hereinafter "sucking-in airflow") in the portion downstream from the developing range in the direction I of rotation of the developing sleeve 45*a*, where developer is collected inside the developing device 40. In the arrangement in which the developing roller 45 faces the developing device casing across a desirable, small gap (represented by "G1" in FIG. 1, hereinafter "casing gap G1"), when developer is transported together with air into the developing device 40 by the developing sleeve 45*a*, the casing gap is sealed. Further, the sucking-in airflow is generated.

Even the developer escaped the retention of the developing roller 45 is transported by the sucking-in airflow toward the interior of the developing device 40 and is collected therein.

To suppress scattering of developer with the sucking-in airflow, the casing gap G1, where the surface of the developing sleeve 45*a* downstream from developing range is closest to the developing device casing, is kept to a desirable size.

The sucking-in airflow is generated by movement of the magnetic brush of developer borne on the developing roller 45. If the casing gap G1 is too wide, it is difficult to generate the sucking-in airflow in the entire area around the casing gap G1.

Specifically, if the casing gap G1 is too wide, clearance is present between an end of the magnetic brush and the developing device casing. As developer moves, an airflow in the direction identical to the direction of movement of developer is generated and increases an internal pressure of the developing device 40. At that time, if clearance is present between the end of the magnetic brush and the developing device casing, pressure escapes through the clearance. Accordingly, when the casing gap G1 between the developing roller 45 and the developing device casing is too wide, the sucking-in airflow is not generated entirely around the casing gap G1, and suppression of scattering of developer becomes insufficient.

Thus, in suppressing scattering of developer, it is advantageous that the magnetic brush of developer contacts the developing device casing.

Additionally, if clearance is present between the developer on the developer bearer and the casing, at the entrance of the casing, an outward airflow flowing from the interior of the casing (hereinafter "flowing-out airflow") is generated. The flowing-out airflow may convey developer out of the casing and further inhibit the sucking-in airflow from conveying the developer into the casing, thus causing scattering of developer. Keeping the developer on the developer bearer in contact with the casing is advantageous in inhibiting the generation of flowing-out airflow.

By contrast, if the casing gap G1 is too narrow, it is possible that some of developer borne on the developing sleeve 45*a* fails to pass through the casing gap G1, and developer overflows downstream from the developing range, thus hindering circulation of developer.

Therefore, the casing gap G1 is set to a sufficient distance to secure circulation of developer, within an extent in which the magnetic brush of developer can contact the developing device casing, considering various conditions of the developing device 40. In the extent to allow the magnetic brush of developer to contact the developing device casing, a desirable size of the casing gap G1 depends on properties of developer, rotation speed of the developing sleeve 45*a*, and an internal structure of the developing device 40. Therefore, it is preferable to adjust the size of the casing gap G1 and shape of the area around the casing gap G1.

When mass productivity of the device is considered, it is difficult to guarantee an accurate size of the casing gap G1 in all products since the casing gap G1 is long in the longitudinal direction of the developing device 40. According to evaluation made by the inventors using a developing device of Pro C750, an image forming apparatus from Ricoh Company, Ltd., the effect to suppress scattering of developer are higher when the casing gap G1 was within a range from 0.7 mm to 0.8 mm.

To guarantee the casing gap size with a tolerance of about ±0.05 mm is difficult when the aluminum extruded product is used as the casing body 121. Specifically, the axial ends of the developing roller 45 are supported by the front and back end plates 240 and 250, and the casing body 121 is supported by the front and back end plates 240 and 250, similarly. Accordingly, the accuracy of the casing gap size is affected by both the dimensional tolerance among the developing roller 45 and the front and back end plates 240 and 250 and that among the casing body 121 and the two end plates. Since the dimensional tolerance thus accumulates, it is difficult to guarantee the casing gap size with a tolerance of about ±0.05 mm.

Additionally, due to machining accuracy, it is difficult to determine the size of the extruded aluminum product.

To set the casing gap G1 to a desirable size, a conceivable approach is to make the position of the casing body 121 adjustable relative to the front end plate 240 and the back end plate 250. For example, the casing body 121 is movable in one direction relative to the front end plate 240 and the back end plate 250 that support the developing roller 45. Then, the developing device 40 is assembled by setting the casing gap size with a predetermined positioning method and securing the casing body 121 to the front and back end plates 240 and 250.

In this configuration, however, the front end plate 240 and the back end plate 250 support the developer conveying screws in addition to the developing roller 45. Accordingly, if priority is given to the casing gap size in positioning the casing body 121, it becomes difficult to guarantee accuracy of clearance between an inner face of the casing body 121 and the circumference of the developer conveying screws.

If the clearance is too large, developer is not properly circulated in the developing device 40, and the concentration of toner becomes uneven, making image density uneven. Additionally, there is a risk that developer accumulating in the developing device 40 aggregates and adheres to the inner face of the developing device 40. If such developer falls and used in image developing, spots appear in images, or toner is partly absent in images like white spots.

By contrast, when the clearance is too small, developer is squeezed between the developer conveying screw and the inner face of the casing body 121, resulting in aggregation or adhesion of developer. Further, if clearance is eliminated, the developer conveying screw is in contact with and rubs on the inner face of the casing body 121, causing inconveniences such as damage to the component.

Additionally, in this configuration, the relative positions of the casing body 121, which is a main part of the developer container, the back end plate 250, and the front end plate 240 are determined by not a positioning reference but a screw after the casing gap size is adjusted. Accordingly, the relative positions with the back end plate 250 and the front end plate 240 tend to be slightly different in each developing device 40. This causes deviation in the axes of bearings at both axial ends of the developing device 40 to support the developing sleeve 45*a* and the developer conveying screws. Accordingly, inconveniences, such as increases in torque at the bearings and toner adhesion due to heat, can arise.

In particular, in response to demand for energy-saving, it is preferred to lower the melting point of toner to reduce the amount of heat in the fixing process. Since heat generated at the bearings of the developing device 40 increases the possibility of aggregation of toner and adhesion of toner, a load torque at the bearings is preferably small.

As illustrated in FIG. 4, the developing device 40 according to the present embodiment further includes a gap adjuster 112 to adjust the size of the casing gap G1 between the casing body 121 and the developing sleeve 45*a*. The gap adjuster 112 is disposed at a position where the surface of the developing sleeve 45*a* that has passed through the developing range (given a reference character "A" in FIG. 1) enters inside the casing body 121. In other words, the gap adjuster 112 is disposed downstream from the developing range (or the opening 51) in the direction I, in which the developing sleeve 45*a* rotates. In one embodiment, the gap adjuster 112 is made of aluminum similar to the casing body 121 and is an attachment (separate component) to the casing body 121. The position of the gap adjuster 112 relative to the casing body 121 is adjustable in a given range. This adjustment enables adjustment of the casing gap size at the position where the surface of the developing sleeve 45*a* downstream from developing range enters inside the casing body 121. Additionally, when the gap adjuster 112 is replaced with a spacer having a different shape, the inner shape of the developing device casing at the position opposing to the developing roller 45 can be changed.

Figure 9:
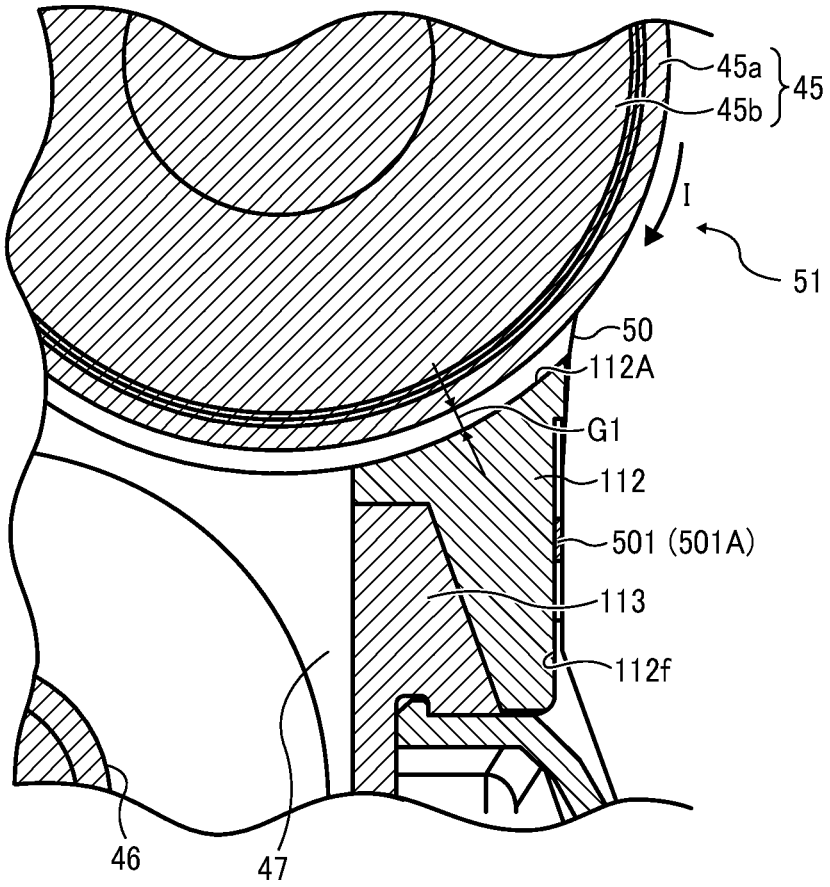
FIG. 9 is an enlarged cross-sectional view illustrating an area adjacent to a casing gap of the developing device illustrated in FIG. 4.

FIG. 9 is an enlarged cross-sectional view illustrating an area adjacent to the casing gap G1 of the developing device 40 illustrated in FIG. 4.

The gap adjuster 112 is removably secured to a gap adjuster mount 113, which is a part of the casing body 121. As illustrated in FIG. 9, the gap adjuster 112 includes a curved face (hereinafter "opposing face 112A) opposing to the developing roller 45 and conforming to the circumference of the developing roller 45. In an adjacent area of the casing gap G1, the developing sleeve 45*a* rotates into the casing body 121 from outside the casing body 121 as indicated by arrow I in FIG. 9.

The gap adjuster 112 is movable along a slope of the gap adjuster mount 113 in a radial direction toward a center of the developing roller 45. The gap adjuster 112 adjusts the casing gap G1 to a given size, for example, about 0.75 mm, in the present embodiment. After the casing gap G1 is adjusted, the gap adjuster 112 is secured to the gap adjuster mount 113 with a screw 501.

When the screw 501 is a metal magnetic body and a head 501A of the screw 501 is exposed, it is possible that the screw 501 is magnetized and carrier adheres thereto. If carrier adheres to the head 501A of the screw 501 situated on a face 112*f* of the gap adjuster 112 opposing to the photoconductor 18, there is a risk of damage to the photoconductor 18.

Therefore, the developing device 40 further includes an entrance seal 50 to cover the head 501A of the screw 501 on the face 112*f* of the gap adjuster 112 opposing to the photoconductor 18, thereby inhibiting carrier from adhering to the face 112*f* of the gap adjuster 112.

To inhibit inconveniences caused by toner scattering even when the charge amount of developer is smaller due to, for example, hot and humid environments, it is advantageous that the casing gap size is small to secure a sufficient sucking-in airflow into the developing device 40.

However, in the configuration in which the gap adjuster 112 and the casing body 121 are made of aluminum and the gap adjuster 112 secured to the casing body 121 is grounded via the casing body 121, there are potential differences between the gap adjuster 112 and the developing roller 45 to which the developing bias is applied. Accordingly, there is an electrical field to move toner from the developing roller 45 to the gap adjuster 112. At that time, if the casing gap size is small to secure the sufficient sucking-in airflow, it is possible that the toner in developer borne on the developing roller 45 electrostatically adheres to the gap adjuster 112.

In the developing device 40, the developing bias is applied to the developing roller 45 to supply toner to the photoconductor 18 due to potential differences between the developing roller 45 and the electrostatic latent image on the photoconductor 18. In a comparative developing device in which the casing gap G1 is wider than the development gap (between the developing roller 45 and the photoconductor 18), the possibility of electrostatic adhesion of toner to the gap adjuster 112 is smaller in standard conditions. However, in configurations in which the casing gap G1 is narrower as in the present embodiment or the developing bias is higher, the possibility of electrostatic adhesion of toner to the gap adjuster 112 is higher when the concentration of toner in developer decreases and the resistance of toner decreases under hot and humid conditions.

Downstream from the casing gap G1 in the direction I (in FIG. 4) in which the developing roller 45 rotates, there is the release portion facing the collecting channel 47. In the release portion, the magnetic force exerted by the magnet roller 45*b* rarely acts on the surface of the developing roller 45, and developer is separated from the developing roller 45 and collected in the collecting channel 47. However, when toner (charged in the negative polarity in the present embodiment) electrostatically adheres to the gap adjuster 112, counter charges (the positive polarity in the present embodiment) are caused on developer (i.e., carrier) borne on the developing roller 45.

The counter charges strengthen the electrostatic adhesion of developer to developing roller 45 and make the developer less separable from the developing roller 45. Then, the developer that has passed through the developing range remains on the developing roller 45 and supplied again to the developing range, together with developer scooped up from the supply channel 49. Thus, the developer reduced in toner concentration is supplied to the developing range, and the image density decreases.

Figure 10A:
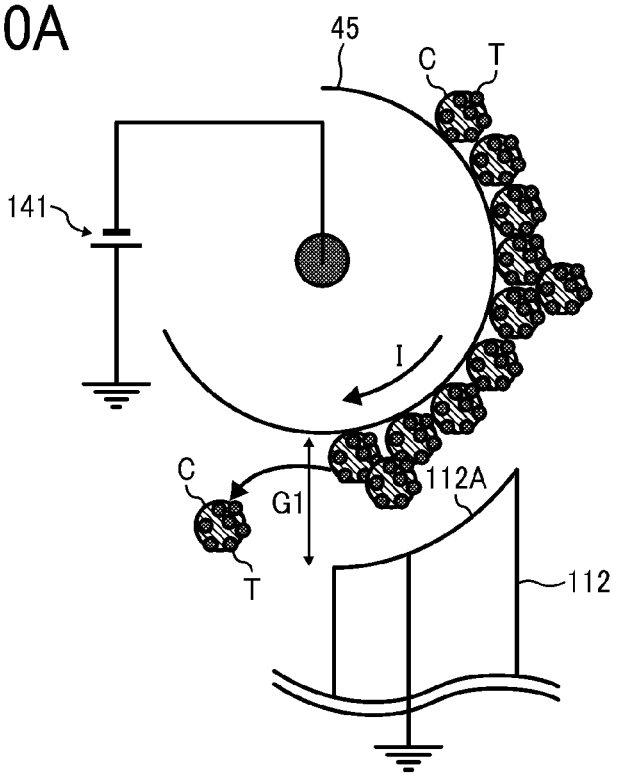
FIG. 10A is a schematic cross-sectional view around a wider casing gap as a comparative example.
Figure 10B:
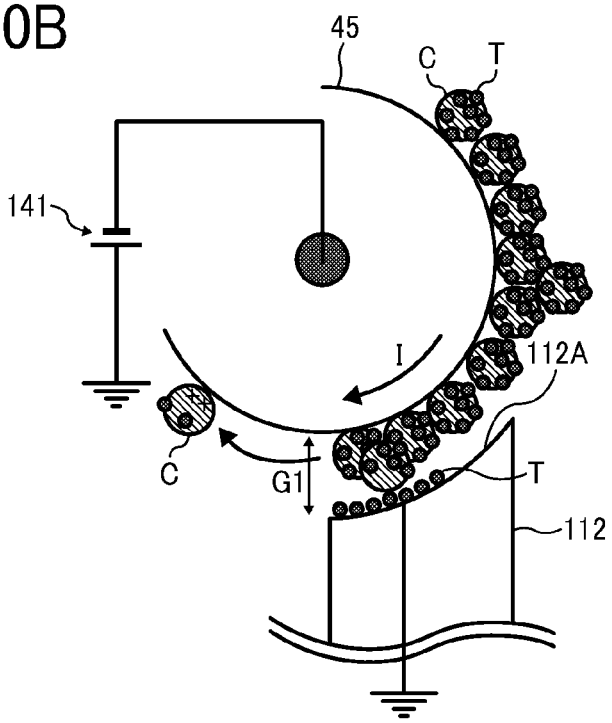
FIG. 10B is a schematic cross-sectional view around a narrower casing gap according to the first embodiment.

FIG. 10A is a schematic cross-sectional view around the casing gap G1 that is wider as a comparative example, and FIG. 10B is a schematic cross-sectional view around the casing gap G1 that is narrower. In FIGS. 10A and 10B, reference character "G" represents developer (i.e., a developer particle), "T" represents toner, and "C" represents carrier.

In FIG. 10A, the casing gap G1 is sufficiently wide to inhibit toner T in developer G borne on the developing roller 45 from electrostatically adhering to the gap adjuster 112. In this case, in the release portion where the magnetic force exerted on the developing roller 45 is small, developer G including toner T and carrier C leaves the developing roller 45 for the collecting channel 47.

By contrast, in FIG. 10B, the casing gap G1 is sufficiently narrow for toner T in developer G borne on the developing roller 45 to electrostatically adhere to the gap adjuster 112.

Since the developing device casing including the gap adjuster 112 is grounded, there is the electrical field to electrostatically move toner from the developing roller 45 to the gap adjuster 112. Accordingly, it is possible that a relatively large amount of toner T electrostatically adheres to the gap adjuster 112 in the configuration illustrated in FIG. 10B.

Counter charges in the positive polarity are caused in the developer (carrier C) from which toner T moves to the gap adjuster 112, and electrostatic adhesion to the developing roller 45, to which the negative polarity developing bias is applied, increases. With this action, even when the developer reaches the release portion, the developer does not leave the developing roller 45 and supplied again to the developing range. This is a phenomenon called "carry-over of developer". Carry-over of developer reduces image density.

FIG. 1 is an enlarged view around the developing roller 45 of the developing device 40 according to the present embodiment. In FIG. 1, reference character G1 represents the casing gap, and A represents the developing range.

The gap adjuster 112 is a part of the developing device casing in which the agitation channel 44, the collecting channel 47, and the supply channel 49 are defined. As illustrated in FIG. 1, the developing device 40 is provided with a power source 141 serving as a developing bias source to apply the developing bias to the developing roller 45.

Further, in a portion around the casing gap G1 downstream from the developing range A, in the direction I in which the developing roller 45 rotates, the developer borne on the developing roller 45 contacts the opposing face 112A of the gap adjuster 112 opposing to the developing roller 45. In the present embodiment, the casing body 121 and the gap adjuster 112 are made of or include conductive aluminum. The gap adjuster 112 includes an insulation layer 123 as a surface layer at the position where the developer borne on the developing roller 45 contacts the gap adjuster 112.

Disposing the insulation layer 123 as illustrated in FIG. 1 is advantageous in inhibiting decreases in image density and in inhibiting adhesion of toner to the gap adjuster 112. In the configuration including the insulation layer 123, the gap adjuster 112 is farther from the surface of the developing roller 45 by a distance equal to the thickness of the insulation layer 123 to keep the casing gap G1 identical to that in the configuration without the insulation layer 123.

It is conceivable that decreases in image density are suppressed by the insulation layer 123 as follows.

Specifically, an electrical field between two electrodes is weakened as the distance between the two electrodes increases, even if the potential difference between the two electrodes does not change. When the insulation layer 123 is provided, the distance between the gap adjuster 112, which is conductive, and the surface of the developing roller 45 is increased by the distance equal to the thickness of the insulation layer 123. Accordingly, the electrical field is weakened, and the electrostatic force to move toner toward the gap adjuster 112 becomes weaker. With this action, electrostatic adhesion of toner to the gap adjuster 112 is inhibited, thereby reducing counter charges caused in the developer borne on the developing roller 45 and suppressing increases in electrostatic adhesion of developer to the developing roller 45. Accordingly, separation of developer from the developing roller 45 in the release portion is promoted and carry-over of developer is inhibited. Thus, decreases in image density is inhibited.

Since the casing gap size is identical to that in the configuration in which the insulation layer 123 is not provided, developer borne on the developing roller 45 contacts the insulation layer 123 on the gap adjuster 112. Thus, the sucking-in airflow is generated. With the sucking-in airflow, developer released from the developing roller 45 is sucked into the developing device 40, thus inhibiting scattering of developer downstream from the developing range. Additionally, decreases in image density are suppressed, thus keeping image density stable.

It is conceivable that the insulation layer 123 is also effective in inhibiting carry-over of developer as follows.

In the configuration in which the insulation layer 123 is not provided, the electrical field is generated between the gap adjuster 112 and the developing roller 45. As toner on the developing roller 45 electrostatically moves to the gap adjuster 112, electrical charges of toner flow into the gap adjuster 112. As a result, the potential of toner on the gap adjuster 112 becomes equal to the ground (0 V), and additional electrostatic move of toner is not hindered.

Meanwhile, in the configuration including the insulation layer 123, an electrical field is generated between the gap adjuster 112 and the developing roller 45 as well, and toner on the developing roller 45 can electrostatically move to the gap adjuster 112. The charges of toner, however, are blocked by the insulation layer 123 and do not flow into the gap adjuster 112. As a result, the toner on the gap adjuster 112 is charged in the polarity equal to that of toner included in developer on the developing roller 45, and further electrostatic move of toner is hindered.

With this action, compared with the configuration without the insulation layer 123, electrostatic adhesion of toner to the gap adjuster 112 is inhibited, thereby inhibiting generation of counter charges in the developer on the developing roller 45. Accordingly, increases in electrostatic adhesion of developer to the developing roller 45 are suppressed, and separation of developer from the developing roller 45 in the release portion is promoted. Thus, carry-over of developer is inhibited.

By inhibiting carry-over of developer, decreases in image density are suppressed.

Experiment 1

The inventors executed the following experiment using the developing device 40 having the narrower casing gap G1, which results in decreases in image density of black solid images.

A sheet was disposed to contact a portion of the release portion of the developing roller 45 in the width direction of the image to be produced, and the black solid image was printed. In the portion where the sheet contacts the developing roller 45 in the width direction of the image, image density did not decrease, but image density decreased in other portions. In the portion where the sheet contacts the developing roller 45, the sheet removes developer from the surface of the developing roller 45, thereby reliably preventing carry-over of developer. Since image density decreased in other portions than the portion where the sheet contacts the developing roller 45, it is conceivable that the narrower casing G1 is a cause of carry-over of developer and resultant decreases in image density.

Subsequently, images were output using a configuration similar to that illustrated in FIG. 4 but different in that the gap adjuster 112 was made floating not grounded, and a configuration including the insulation layer 123 disposed on the opposing face 112A of the gap adjuster 112 opposing to the developing roller 45.

In the former of the two configurations tested, to make the gap adjuster 112 floating, an insulator was interposed between the gap adjuster 112 and the casing body 121 to block electrical current between the gap adjuster 112 and the casing body 121.

In the latter, polytetrafluoroethylene (PTFE) tape was bonded to the opposing face 112A of the gap adjuster 112 as the insulation layer 123.

In the comparative developing device 40 in which the gap adjuster 112 is grounded via the casing body 121, image density of black solid images tends to decrease. By contrast, decreases in image density were suppressed in the configuration including the floating gap adjuster 112 and the configuration including the insulation layer 123 on the gap adjuster 112.

The followings are conceivable from results of Experiment 1.

In the comparative developing device 40, due to the electrical field between the gap adjuster 112 and the developing roller 45, the toner in developer on the developing roller 45 electrostatically moves to the gap adjuster 112 in the area around the casing gap. Then, counter charges are caused in the developer (carrier) remaining on the developing roller 45, strengthening the electrostatic adhesion of developer to developing roller 45. Thus, carry-over of developer occurs. Then, the developer reduced in toner concentration is supplied to the developing range, and the image density of black solid images decreases.

In view of the foregoing, in the developing device 40 according to the present embodiment, the insulation layer 123 is longer than the developing range in the longitudinal direction of the developing device 40 so that both ends of the developing range are aligned with or inside the ends of the insulation layer 123. This configuration is effective in inhibiting the occurrence of carry-over of developer entirely in the developing range in the longitudinal direction of the developing device 40.

Experiment 2

Figure 11:
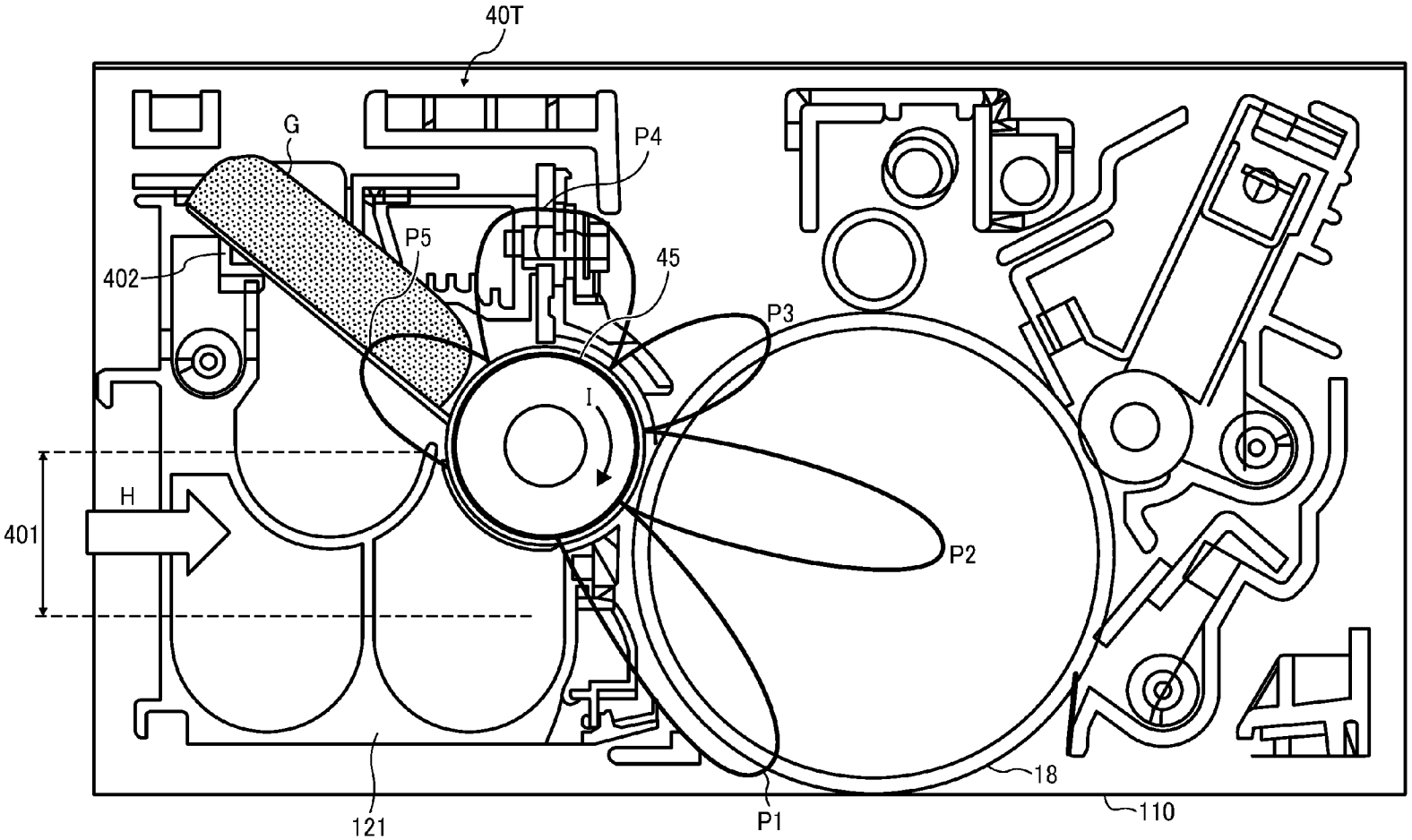
FIG. 11 is an end-on axial view of a developing device modified for use in Experiment 2.

FIG. 11 is an end-on axial view of a modified developing device 40T used in Experiment 2. It is to be noted that bold petal-like lines with reference characters P1 through P5 in FIG. 11 represent density distribution (absolute value) of magnetic flux generated by the respective magnetic poles on the developing roller 45 in the direction normal to the surface of the developing roller 45.

Using the developing device 40T, the developing bias was applied to the developing roller 45, and then the occurrence of carry-over of developer was checked.

In the developing device 40T, a window 401 was formed in the casing body 121 to observe the release portion and adjacent portions, and the three developer conveying screws were removed. When viewed in the direction indicated by arrow H in FIG. 11, the surface of the developing roller 45 in the release portion was visible from outside. Pictures of the surface of the developing roller 45 in the release portion was taken with a high-speed camera through the window 401.

Additionally, developer G is loaded on a slope 402 to supply the developer G to the developing roller 45 for a given period continuously.

Test conditions are as follows.

Developing device: Modification of a developing device for Ricoh Pro C750 (with the developing device casing grounded);

Casing gap: 0.70 mm;

Amount of developer scooped onto the developing roller: 40 mg/cm$^2$;

Developing roller linear speed: 529.2 mm/s;

Developer: Black developer for used in Ricoh Pro C750 (with a toner concentration of 4% by weight);

Developing bias: −400 V, −500 V, −600 V, −700 V, and −800 V;

Camera: Casio High-speed camera, EXILIM EX-FH20; and

Shooting condition: Frame rate of 210 frames per second (fps)

In Experiment 2, the configuration in which the gap adjuster 112 was provided with the insulation layer 123 and the configuration without the insulation layer 123 were used.

In the former of the two configurations tested, as the insulation layer 123, PTFE tape (No. 5490) from 3M Japan Limited was bonded to the opposing face 112A of the gap adjuster 112. The gap adjuster 112 was disposed to keep the distance (the casing gap G1) of 0.70 mm from the surface of PTFE tape to the surface of the developing roller 45.

In the clatter configuration, the opposing face 112A of the gap adjuster 112 opposing to the developing roller 45 was not insulated, and the gap adjuster 112 was disposed at a distance of 0.70 mm (the casing gap G1) from the developing roller 45.

Results of Experiment 2 are in Table 1 below.

TABLE 1

| Developing bias | Occurrence of carry-over of developer | |
|---|---|---|
| (V) | With PTFE tape | Without PTFE tape |
| −400 | No | No |
| −500 | No | No |
| −600 | Occurred | No |
| −700 | Occurred | No |
| −800 | Occurred | No |

According to Table 1, the occurrence of carry-over of developer is inhibited by providing the PTFE tape (the insulation layer 123) on the opposing face 112A opposing to the developing roller 45. Thus, decreases in image density resulting from carry-over of developer are suppressed.

It is to be noted that, although the PTFE tape was used in Experiment 2 to insulate the opposing face 112A, isolation is not limited thereto. Alternatively, for example, typical aluminum anodizing may be used. Yet alternatively, another type of insulation tape or coating with an insulative material may be applied to the gap adjuster 112.

Experiment 3

Experiment 2 described above concerns use of the PTFE tape to insulate the opposing face 112A of the gap adjuster 112. In long-life developing devices capable of image developing on a hundred thousand sheets or greater, coating is preferred to adhesive insulators, such as, tape having an adhesive layer from the following cause.

Specifically, when the surface of insulation tape that contacts developer wears and the adhesive layer is exposed, there arises the possibility that developer adheres to the gap adjuster 112, the casing gap G1 is clogged with developer, and an adhesive material adheres to developer, causing the developer to aggregate.

In view of the foregoing, Experiment 3 concerns use of an insulative coating to insulate the gap adjuster 112 without using an adhesive layer. In particular, the occurrence of carry-over of developer was checked in a configuration including an insulative resin coating layer made of ethylene-tetrafluoroethylene copolymer (ETFE) and a configuration without the insulation layer 123.

In Experiment 3, similar to Experiment 2, the configuration illustrated in FIG. 11, modified from the developing device 40, was used.

Test conditions are as follows.

Developing device: Modification of a developing device for Ricoh Pro C750 (with the developing device casing grounded);

Casing gap: 0.70 mm;

Amount of developer scooped onto the developing roller: 40 mg/cm$^2$;

Developing roller linear speed: 529.2 mm/s;

Developer: Black developer for used in Ricoh Pro C750 (with a toner concentration of 4% by weight);

Developing bias: −400 V, −500 V, −600 V, −700 V, and −800 V;

Camera: Casio High-speed camera, EXILIM EX-FH20;

Shooting condition: Frame rate of 210 frames per second (fps); and

Insulation layer: ETFE resin coating layer (TC-820 from Tsuchiya Co., Ltd., film thickness: 20 μm)

Similar to Experiment 2, in the configuration without the insulation layer 123, the opposing face 112A of the gap adjuster 112 opposing to the developing roller 45 was not insulated, and the gap adjuster 112 was disposed at a distance of 0.70 mm (the casing gap G1) from the developing roller 45.

In the configuration including the insulation layer 123, the opposing face 112A of the gap adjuster 112 was coated with ETFE resin. The insulation layer 123 had a film thickness of 20 nm. The gap adjuster 112 was disposed to keep the distance (the casing gap G1) of 0.70 mm from the surface of the ETFE coating layer to the surface of the developing roller 45.

Results of Experiment 3 are in Table 2 below.

TABLE 2

| Developing bias | Occurrence of carry-over of developer | |
|---|---|---|
| (V) | With ETFE coating | Without ETFE coating |
| −400 | No | No |
| −500 | No | No |
| −600 | Occurred | No |
| −700 | Occurred | No |
| −800 | Occurred | No |

According to Table 2, the occurrence of carry-over of developer is inhibited by providing the ETFE resin coating layer (the insulation layer 123) on the opposing face 112A opposing to the developing roller 45. The resin usable as insulation layer 123 includes polytetrafluoroethylene (PTFE), polyimide (PI), polyamide imide (PAI), acrylic resin, and epoxy resin in addition to ETFE. When the occurrence of carry-over of developer downstream from the casing gap was checked in each of configurations using the above-listed resins as the coating of the opposing face 112A opposing to the developing roller 45, carry-over of developer was not observed. The resin usable for the insulation layer 123 is not limited to the examples mentioned above but includes any insulative resin.

The coating layer of the opposing face 112A of the gap adjuster 112 is produced by any of splaying, electropainting, electrostatic coating, and other methods capable of coating aluminum.

The inventors have confirmed durability of the insulation layer 123 made of the ETFE resin coating, applied to the gap adjuster 112, in the developing device 40. Specifically, the amount by which the insulation layer 123 was abraded by sliding contact of developer was measured after the developing device 40 was driven for image developing on 594,000 sheets. Based on the amount of abrasion measured, the decrease in film thickness of the insulation layer 123 after image developing on 5,400,000 sheets was estimated. Although the decrease in film thickness varied among a proximal end portion, a center portion, and a distal end portion in a direction perpendicular to the cross-section illustrated in FIG. 4, the estimated amount was 24.6 μm in the proximal end portion, where the decrease was greatest among the three portions. Accordingly, when the insulation layer 123 has a film thickness of about 30 μm or greater, the insulation layer 123 is maintained after the developing device 40 is driven for 5,400,000 sheets. Then, carry-over of developer and resultant image density decrease are suppressed.

Experiment 4

In Experiment 4, in the configuration including the resin coating as the insulation layer 123, differences in adhesion of toner to the face 112*f* (illustrated in FIG. 9) of the gap adjuster 112 facing the photoconductor 18, depending on a surface smoothness of the resin coating, were researched. For Experiment 4, the developing device for used in Ricoh Pro C750 was modified to provide the insulation layer 123 to the opposing face 112A of the gap adjuster 112 opposing to the developing roller 45. Test conditions are as follows.

[Machine Specifications]

Apparatus type: Ricoh Pro C750;

Developing device: Modification of a developing device for Ricoh Pro C750 (with the developing device casing grounded);

Insulation layer: Coating with polyimide (PI), ETFE, or PTFE; and

Casing gap: 0.8 mm;

[Printing Conditions]

Image area ratio: 0.5%; and

Number of sheets printed: 10,000;

Table 3 below shows an angle of contact with water of each resin material and the amount of toner adhering (hereinafter "toner adhesion amount") to the face 112*f* of the gap adjuster 112 facing the photoconductor 18.

TABLE 3

| Coating material | Angle of contact with water (in degrees) | Toner adhesion speed (mg/km) |
|---|---|---|
| PI | 80 | 8.2 |
| ETFE | 95 | 2 |
| PTFE | 105 | 0.48 |

Figure 12:
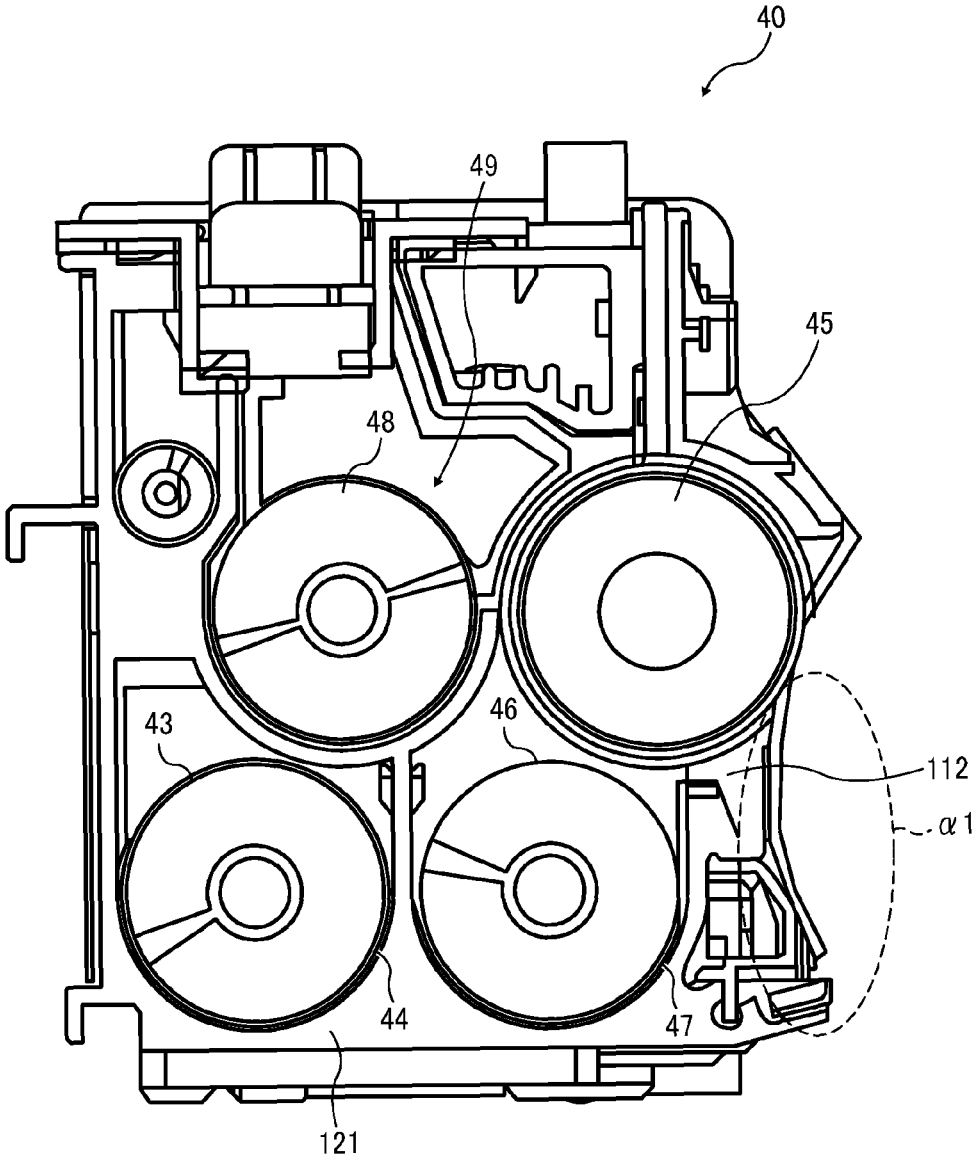
FIG. 12 is an end-on axial view of location of measurement of toner adhesion amount in a developing device according to the first embodiment.

FIG. 12 is an end-on axial view of the developing device 40, in which location of measurement of the toner adhesion amount is marked.

In Experiment 4, after printing on 10,000 sheets, toner in an area α1 in FIG. 12 (in FIG. 9) was collected, and toner adhesion speed was calculated based on the toner adhesion amount measured.

Toner adhered to the PI coating entirely and rarely adhered to the ETFE coating and the PTFE coating. According to this result, toner is more likely to adhere to the resin coating when the angle of contact with water of the resin material is greater.

According to the results of Experiment 4, although toner adheres to the face 112*f* of the gap adjuster 112 facing the photoconductor 18, toner is inhibited from falling to an unintended position on the intermediate transfer belt 15 as long as the toner adhesion speed is 3 mg/km or lower. Accordingly, creation of substandard images including smear with toner or spots is inhibited.

The "toner adhesion speed" used here is calculated as follows. Form images having an image area ratio of 0.5%, at which the possibility of toner adhesion is higher, on 10,000 sheets, measure the amount of toner adhering to the face 112*f* of the gap adjuster 112 at that time, and divide the measured amount by the running distance of the photoconductor 18.

According to Table 3, smear with toner (toner adhesion) of the face 112*f* of the gap adjuster 112 facing the photoconductor 18 is inhibited by choosing, as the insulation layer 123, the resin material to which toner is less likely to adhere.

Figure 13:
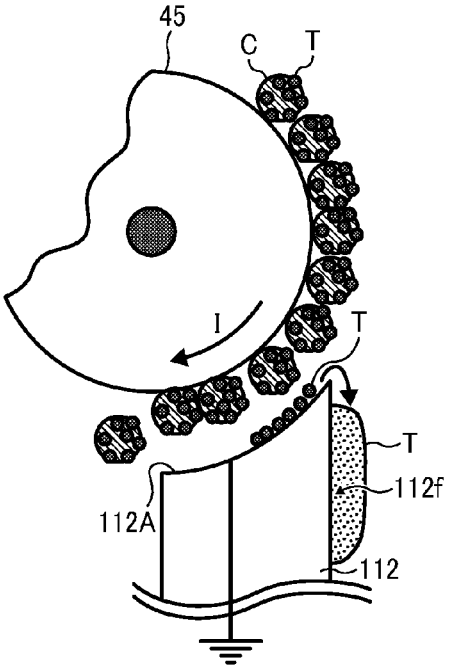
FIG. 13 is a schematic illustration of adhesion of toner to a face of a spacer facing a photoconductor according to the first embodiment.

FIG. 13 is a schematic illustration of adhesion of toner to the face 112*f* of the gap adjuster 112 facing the photoconductor 18.

If toner adhering to the opposing face 112A of the gap adjuster 112 opposing to the developing roller 45 is not scraped off by developer borne on the developing roller 45, toner accumulates on the opposing face 112A. Although the insulation layer 123 is effective in inhibiting electrostatic adhesion of toner to the opposing face 112A, depending on the material of the insulation layer 123, it is still possible that insufficiently charged toner adheres thereto. As the amount of toner adhering to the opposing face 112A increases, the portion to which toner adheres gradually moves to the upstream side in the direction I, in which the developing roller 45 rotates. Then, the toner adheres to the face 112*f* of the gap adjuster 112 facing the photoconductor 18 as illustrated in FIG. 13.

By contrast, when the resin material to which toner is less likely to adhere is used for the surface of the insulation layer 123, the insufficiently charged toner on the insulation layer 123 is easily scraped off by the developer borne on the developing roller 45, thereby inhibiting accumulation of toner. Thus, adhesion of toner to the face 112*f* of the gap adjuster 112.

If toner adhering to the face 112*f* facing the photoconductor 18 accumulates to an aggregation of certain size, it is possible that the aggregation falls from the gap adjuster 112 to an unintended position of the intermediate transfer belt 15, resulting in substandard images including toner smear and spots.

By contrast, creation of such substandard images is inhibited by reducing the toner adhesion to the face 112*f* of the gap adjuster 112 facing the photoconductor 18.

As shown in Table 3, it is preferable that the angle of contact with water of the resin material is 95° or greater. According to the results shown in Table 4, used of ETFE or PTFE is advantageous in reducing the adhesion of toner to the face 112*f* of the gap adjuster 112 facing the photoconductor 18 and inhibiting creation of such substandard images.

Table 4 illustrates evaluation of properties (insulation capability, angle of contact with water, and surface smoothness) of the insulation layer 123 and effects on inhibition of toner adhesion and carry-over of toner. Items not evaluated are indicated as "N/A".

TABLE 4

| Insulation type | Film thickness (μm) | Insulation capability (Ω/cm) | Angle of contact with water (degrees) | Surface smoothness | Toner adhesion speed (mg/km) | Carry-over of developer |
|---|---|---|---|---|---|---|
| No | — | Poor | N/A | Poor | Poor 8.9 to 15.5 | Poor |
| Aluminum anodizing | 30 | Acceptable | N/A | Poor | Poor 4.55 to 37.9 | Acceptable |
| PTFE coating | 100 | $10 \times 10^{16}$ | 103 | Acceptable | Excellent 0.4 to 0.48 | Excellent |
| PI coating | 100 | $1.5 \times 10^{16}$ | 80 | Good | Acceptable 2.3 to 8.2 | Excellent |
| Fluorine coating | 200 | $10 \times 10^{16}$ | 95 | Acceptable | Excellent 1.6 to 2.0 | Excellent |
| Ceramic coating | 300 | $10 \times 10^{17}$ | Hydrophilic | Acceptable | Poor 34.5 to 46.9 | Excellent |
| Epoxy coating | 300 | $10 \times 10^{13}$ | N/A | Good | N/A | Acceptable |
| PAI coating | 300 | $10 \times 10^{14}$ | N/A | Good | N/A | Excellent |
| PTFE coating | N/A | Good | N/A | Excellent | Excellent 0.2 to 0.3 | Excellent |

In Table 4, the surface smoothness of the insulation layer 123 and carry-over of developer are rated in four grades of "Poor", "Acceptable", "Good", and "Excellent". When the surface was not smooth and spotty, it was rated "Poor".

According to Table 4, insulation (such as the insulation layer 123) of given type is effective in alleviating carry-over of developer. Regarding carry-over of developer, among the coating types, the epoxy coating is rated at "Acceptable", whereas polyamide imide (PAI) is rated at "Excellent". Accordingly, it is preferable that, regarding the insulation capability, the coating material has a volume resistivity of $1\times10^{14}$ Ω/cm or greater.

Second Embodiment

A second embodiment is described below. It is to be noted that each element identical or corresponding to that in the first embodiment is given an identical or similar reference character, and redundant descriptions are omitted.

The image forming apparatus 500 according to the second embodiment is different from that according to the above-described first embodiment in that multiple radiating ribs are used to cool, with airflow, the developing devices 40 instead of the liquid-cooling device 30 illustrated in FIG. 4. Other than that, the image forming apparatus 500 according to the second embodiment is similar in configuration to that illustrated in FIG. 2.

The second embodiment is advantageous in that a desired superimposed voltage is applied to a developer bearer, thereby improving image quality, in a developing device including a casing that is grounded electrically.

Casings made of metal having higher radiation capability are advantageous in facilitating cooling to suppress temperature rise inside developing devices. However, when the developing bias is applied to the developer bearer in the developing device including the metal casing, electrical charges tend to accumulate in the casing. There is the possibilities of discharge of accumulating electrical charges between the developing device and the interior of the image forming apparatus and inconvenience such as leak. Accordingly, the casing itself is electrically grounded to release the accumulating electrical charges.

In the developing device including the metal casing that is grounded, however, when the developing bias is applied to the developer bearer, the superimposed voltage branches and flows to the latent image bearer and the casing. Consequently, the voltage applied to the developer bearer is not a desired amount, and effects of the developing bias on granularity, which is an item to evaluate how images look grainy, and uneven image density are not fully attained. Simultaneously, white voids around solid portions can be worsened.

As described above, in the developing devices 40, heat is generated by sliding contact between developer and the developer conveyor as well as contact among developer particles, and temperature rises inside the developing devices 40. The temperature inside the developing device 40 can rise also due to sliding contact between developer and the developer regulator to adjust the amount of developer on the developer bearer and contact among developer particles being regulated by the developer regulator.

When the temperature inside the developing device 40 rises, the amount of charge of toner decreases, and the amount of toner adhering to the latent image bearer decreases, thereby, making it difficult to attain desired image density. Moreover, the temperature rise can fuse toner and cause the toner to adhere to the developer regulator, the developer bearer, and the latent image bearer. The toner adhering to such components can create streaks in images, degrading image quality. As printing speed increases, developing devices are more easily heated. The possibility of image failure caused by adhesion of toner is also higher when toner having a lower melting temperature is used to reduce energy for image fixing.

Therefore, in the present embodiment, the casing of the developing device 40 includes a material higher in heat conductivity, such as aluminum and copper, and includes the multiple radiating ribs for the cooling airflow.

Figure 14:
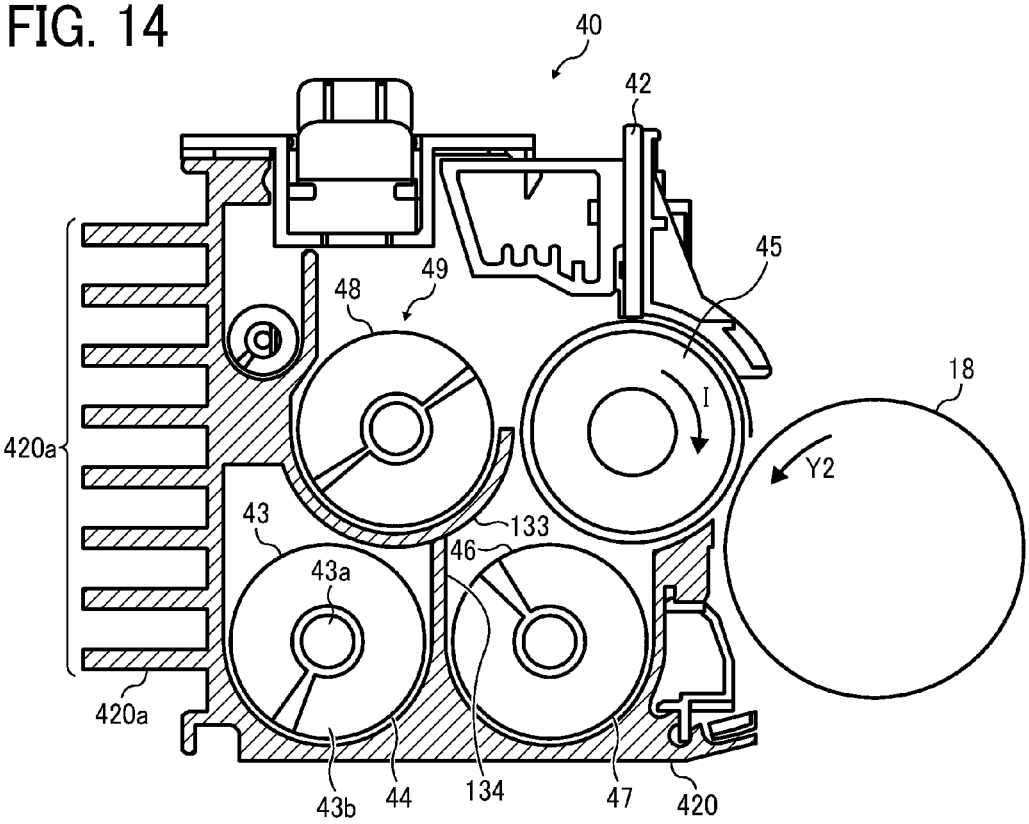
FIG. 14 is a schematic cross-sectional view of a developing device and a photoconductor according to a second embodiment.

FIG. 14 is a schematic cross-sectional view of the developing device 40 and the photoconductor 18 according to the second embodiment. In FIG. 14, reference numeral 420 represent the casing of the developing device 40 serving as the developer container.

Configurations and operation of the developing device 40 and the photoconductor 18 are described with reference to FIG. 14.

The casing 420 of the developing device 40 includes the walls surrounding the agitation channel 44, the collecting channel 47, and the supply channel 49 and radiating ribs 420*a* serving as cooling portions. At least a part of the casing 420 is made of metal, such as aluminum, higher in heat conductivity. To facilitate release of heat from the developing device 40, the radiating ribs 420*a* are disposed on a side wall of the casing 420 (on the left in FIG. 14) 411 and monolithic with the casing 420. In one embodiment, a portion with hatching in FIG. 14 is made of metal. That is, the radiating ribs 420*a*, the bottom and the left side of the casing 420, the first partition 133, the second partition 134, and the walls surrounding the collecting channel 47 and the agitation channel 44 are made of metal. The metal portion of the casing 420 is grounded electrically to inhibit accumulation of charges on the metal portion of the casing 420 and resultant discharge to the interior of the apparatus, upon application of the developing bias. It is to be noted that the metal of the casing 420 serving as the developer container is not limited to aluminum but can be other metals such as copper having a higher heat conductively.

Two-component developer including carrier (carrier particles) and toner (toner particles) is contained in the casing 420.

Unless otherwise specified below, configurations and arrangement of the developing roller 45, the agitation channel 44, the collecting channel 47, the supply channel 49, the developer conveying screws, the doctor blade 42, the first and second partitions 133 and 134, and related components are similar to those according to the first embodiment, and thus descriptions thereof are omitted.

Figure 15:
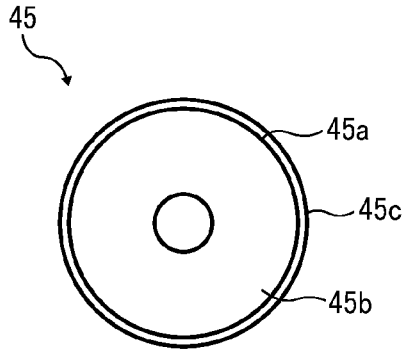
FIG. 15 is a cross-sectional view of a developing roller according to the second embodiment.

FIG. 15 is an end-on axial view of the developing roller 45 according to the present embodiment.

The developing roller 45 illustrated in FIG. 15 includes the rotatable developing sleeve 45*a* and the magnet roller 45*b*, serving as a magnetic body, disposed inside the developing sleeve 45*a*. Although the magnet roller 45*b* is represented with a single shape, the magnet roller 45*b* includes multiple magnetic poles. The magnet roller 45*b* exerts magnetic force to retain developer on the surface of the developing roller 45.

Multiple recesses are spaced apart, either regularly or irregularly, on the surface of the developing sleeve 45*a* not to overlap each other. In a plan view, the recesses are circular or oval, for example. The surface of the developing sleeve 45*a* can be processed to have the recesses according to the methods mentioned in U.S. Pat. No. 7,925,192-B, which is hereby incorporated by reference herein.

The developing sleeve 45*a* further includes a low friction film 45*c* as a surface layer. The low friction film 45*c* is a thin coating layer of a material, such as tetrahedral amorphous carbon (ta-C), titanium nitride (TiN), or the like, that is lower in friction coefficient with toner than the base material of the developing sleeve 45*a*.

Formation of a ta-C film using filtered cathodic vacuum arc (FCVA) is described.

Put high purity carbon (graphite), as a target, in a substantially vacuum chamber, and subject the target to arc discharge. Using electromagnetic induction, guide plasma generated by the arc discharge to the base material of the developing sleeve 45*a*. During the electromagnetic induction, remove substances, such as macro particles, neutral atoms, molecules, and the like that are unnecessary for vapor deposition by an electromagnetic spatial filter and extract ionized carbon only. Then, the ionized carbon that reaches the base material of the developing sleeve 45*a* aggregates into a ta-C film. Thus, the low friction film 45*c* made of the ta-C film is formed on the developing sleeve 45*a*.

The low friction film 45*c* made of the ta-C film can be more uniform in thickness than films formed through plating or coating. Further, since formable at a relatively low temperature, the ta-C film is less likely to be distorted by the temperature of the developing sleeve 45*a*. Accordingly, the accuracy in shape of the developing sleeve 45*a* can be enhanced. It is to be noted that, since vapor deposition using FCVA is described in, for example, U.S. Pat. No. 6,031,239 (A), which is hereby incorporated by reference herein, and widely used in practice, detailed descriptions thereof are omitted.

Alternatively, the low friction film 45*c* may be a TiN film formed using hollow cathode discharge (HCD). Through ion plating, which is a type of physical vapor deposition (PVD), a film that excels in adhesion can be produced relatively easily. Among ion plating methods, HCD is particularly advantageous in producing a coating that is homogeneous and uniform in thickness along a surface roughness of a base material. It is to be noted that, since vapor deposition using HCD is described in, for example, Japanese patent publication Nos. JP-H10-012431-A and JP-H08-286516-A, which are hereby incorporated by reference herein, and widely used in practice, detailed descriptions thereof are omitted.

Needless to say, as long as lower in friction coefficient with toner than the base material of the developing sleeve 45*a*, the material of the low friction film 45*c* is not limited to ta-C and TiN but can be other materials such as titanium carbide (TiC), titanium carbonitride (TiCN), molybdic acid, or the like. The friction coefficient of aluminum alloy is about 0.5 or greater, that of TiN is about 0.3 to 0.4, that of ta-C is about 0.1 or smaller.

Formation of the low friction film 45*c* is subsequent to formation of the recesses on the surface of the developing sleeve 45*a*. In other words, the recesses on the surface alleviate reduction over time in the amount of developer transported, thereby inhibiting uneven image density. The low friction film 45*c* reduces friction with developer, thereby inhibiting adhesion of toner to a non-image area of the developing sleeve 45*a*. This configuration suppresses image failure such as afterimage, which is a phenomenon that a past image history for one rotation of the photoconductor faintly appears on the subsequent image.

Descriptions are given below of measurement of surface friction coefficient of the low friction film 45*c*.

Figure 16:
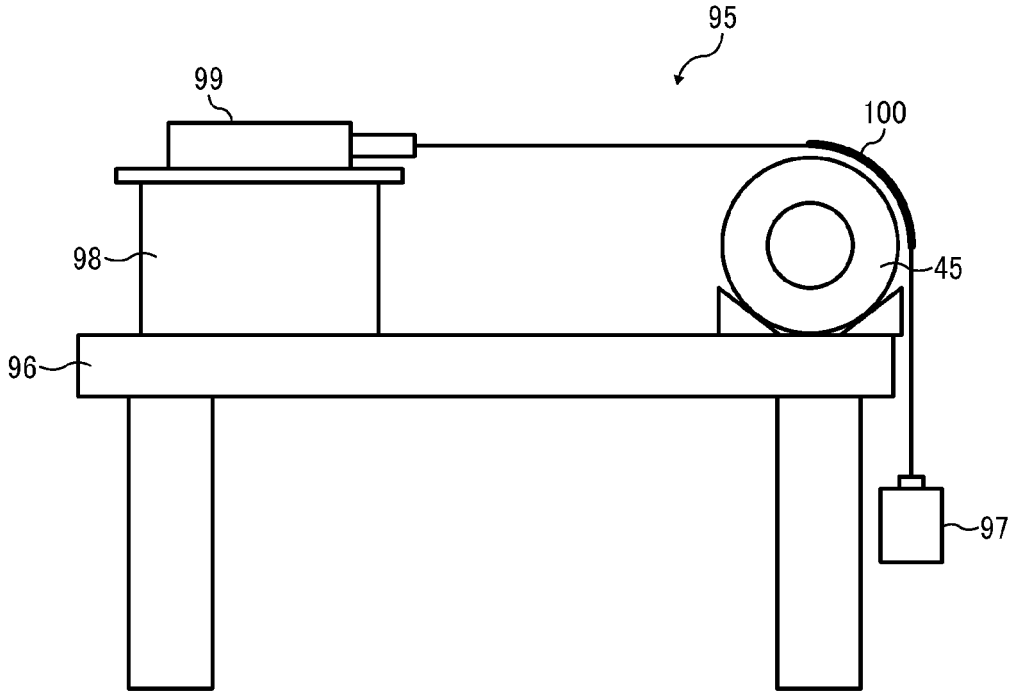
FIG. 16 is a schematic view illustrating a friction coefficient measuring device according to Euler's belt theory.

FIG. 16 is a schematic view illustrating a friction coefficient measuring device according to Euler's belt theory.

Using a friction coefficient measuring device 95 in FIG. 16, according to Euler's belt theory, the friction coefficient of the developing sleeve 45*a* coated with the low friction film 45*c* is measured as follows. The developing roller 45 is placed on a table 96, and a force gauge 99 is placed on a mount 98 on the table 96. The friction coefficient measuring device 95 shown in FIG. 16 further includes a belt 100 made of fine paper of medium thickness, and a weight 97 (a load). The belt 100 is placed with paper grain aligned with a longitudinal direction of the belt 100 and entrained one fourth of the circumference of the developing roller 45. The weight 97 weighs, for example, 0.98 N (100 grams) and is hung from one end of the belt 100, and the force gauge 99 is disposed at the other end of the belt 100.

While the force gauge 99 is pulled by the weight 97, a reading F of the load when the belt 100 moves is read. The reading F is assigned in the following formula to calculate a stationary friction coefficient (μs):

$$\mu s=(2/\pi)\times\ln(F/0.98)$$

Figure 17:
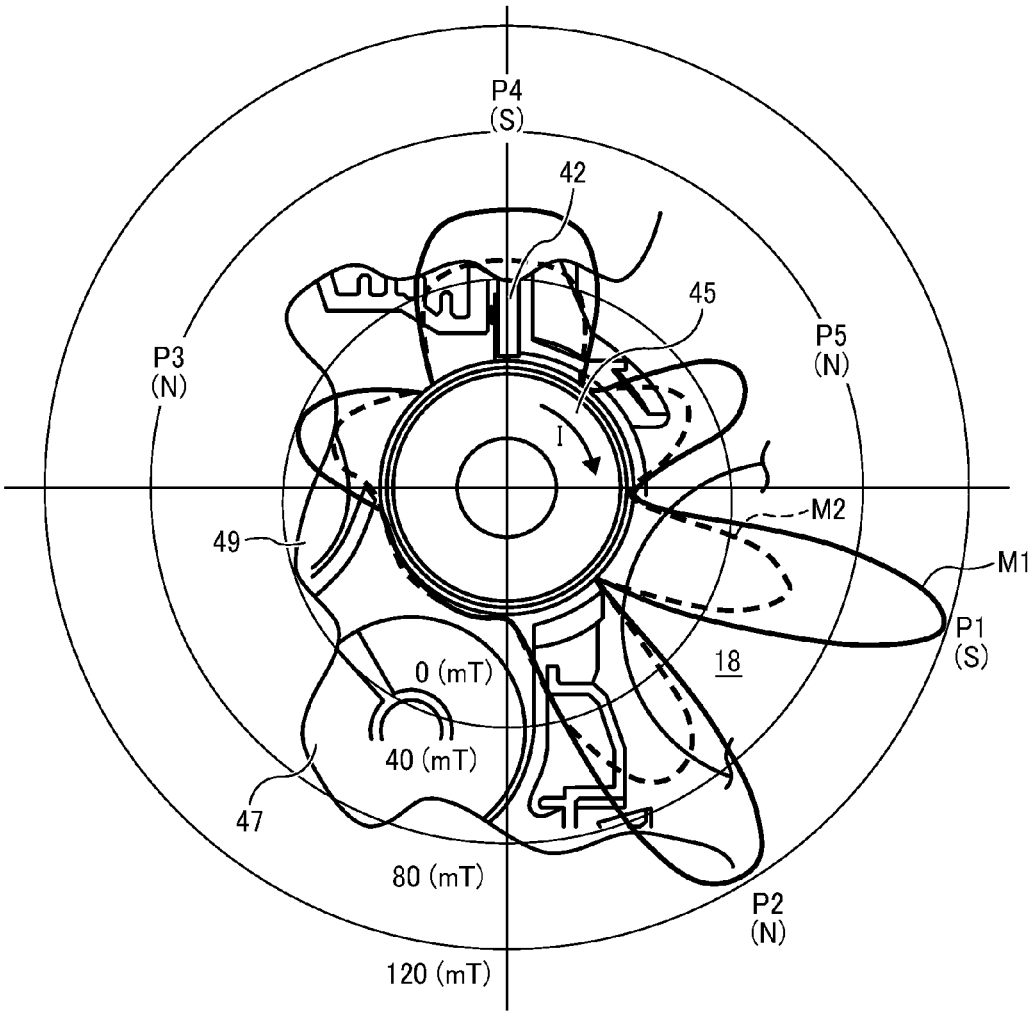
FIG. 17 is an end-on axial view of the developing roller illustrated in FIG. 15, overlapped with absolute values of magnetic flux density in a direction normal to the surface of the developing roller.

FIG. 17 is an end-on axial view of the developing roller 45 overlapped with absolute values of magnetic flux density in the direction normal to the surface of the developing roller 45 (hereinafter "density values of normal direction magnetic flux").

Reference characters P1 through P5 represent the magnetic poles of the magnet roller 45*b*, and S and N in brackets represent south and north as polarity thereof. In FIG. 17, a solid line M1 represents density values on the surface of the developing sleeve 45*a* of the normal direction magnetic flux, and broken lines M2 represent density values at 1 mm away from the surface of the developing sleeve of the normal direction magnetic flux.

Table 5 shows peak values (mT) of the normal direction magnetic flux on the surface of the developing sleeve (distance: 0 mm) and that at 1 mm from the surface of the developing sleeve 45*a* for each magnetic pole.

TABLE 5

| | | Peak value of normal direction magnetic flux (mT) | | | | |
|---|---|---|---|---|---|---|
| | | P1 | P2 | P3 | P4 | P5 |
| Distance | 0 | −120 | 118 | 38 | −60 | 60 |
| (mm) | 1 | −68 | 73 | 26 | −47 | 36 |

Behavior of developer relative to the magnetic poles is described below with reference to FIG. 17.

Developer in the supply channel 49 is scooped onto the developing roller 45 by the magnetic force exerted by a developer scooping pole P3 (N pole) and transported in the direction indicated by arrow I (clockwise in FIG. 17). The developer is then caused to stand on end by a regulation pole P4 (S pole) and regulated by the doctor blade 42. The developer is transported further by a conveyance pole P5 (N pole) and faces the photoconductor 18 in a main pole P1 (S pole), where toner is supplied to the photoconductor 18. The developer is transported further by a conveyance pole P2 (N pole), separated from the developing roller 45 by the repulsive magnetic pole between the conveyance pole P2 and the developer scooping pole P3, and collected in the collecting channel 47.

The main pole P1 is described in further detail. The main pole P1 exerts the magnetic force to make the developer to stand on end into the magnetic brush on the developing roller 45 situated at the small gap (development gap) from the photoconductor 18. In the portion where the magnetic brush slides on the photoconductor 18, charged toner in the magnetic brush of developer is transferred to the latent image on the photoconductor 18 by the difference in linear speed between the photoconductor 18 and the developing roller 45 and the developing bias. The magnetic strength of the main pole P1, the width of contact (i.e., a developing nip width) between the magnetic brush and the photoconductor 18, and the linear speed difference affect images and the occurrence of image failure called voids around solid portions.

In particular, voids at an end of a solid image occur as follows. Counter charges arise when toner to develop a solid portion leaves carrier. Keeping the counter charges, the magnetic brush moves from the solid portion to a halftone portion. The magnetic brush then electrostatically draws back toner from the boundary between the solid portion and the halftone portion on the photoconductor 18. Thus, voids at the end of the solid image occur.

As a conceivable approach to avoid adverse effects of counter charges, the linear speed ratio between the developing roller and the photoconductor 18 may be reduced. It means that the rotation speed of the developing roller 45 is made closer to that of the photoconductor 18 although generally the rotation speed of the developing roller 45 is higher. Alternatively, it is conceivable to reduce the diameter of the developing roller 45 to reduce the width of contact with the photoconductor.

The reduction in linear speed ratio, however, means decreases in developability and may result in insufficient image density. The reduction in diameter of the developing roller 45 means reduction in magnet size therein. It is possible that the magnetic force is insufficient at the end of the magnetic brush (on the photoconductor side), and carrier adheres to the photoconductor, attracted by electrical force from the photoconductor.

To reduce the width of contact between the magnetic brush and the photoconductor without substantially reducing the linear speed ratio and the diameter of the developing roller, an attenuation ratio of the normal direction magnetic flux of the main pole P1 is 40% or greater in one embodiment. The term "attenuation ratio" used here is defined as a ratio obtained by dividing, with the peak value of the normal direction magnetic flux on the surface of the developing sleeve 45*a*, the difference between the peak value of the normal direction magnetic flux on the surface of the developing sleeve 45*a* and that at 1 mm away from the surface of the developing sleeve.

In the present embodiment, as shown in Table 5, in the main pole P1, the peak value of the normal direction magnetic flux on the surface of the developing sleeve 45*a* is −120 mT, and that at 1 mm away from the surface of the developing sleeve 45*a* is −68 mT. The amount by which the normal direction magnetic flux density decreases (absolute value of the difference) is 52 mT. Accordingly, the attenuation ratio is 43%.

Since the attenuation ratio is thus greater than 40% in the present embodiment, the width of contact between the magnetic brush and the photoconductor 18 can be reduced without changing the linear speed ratio as well as the developing roller diameter. Thus, white voids around the solid portion, in particular, at the end of the solid image, are suppressed.

It is to be noted that, similar to the first embodiment, the power source 141 (in FIG. 1) is connected to the developing roller 45 to apply the developing bias thereto, and the photoconductor 18 is grounded electrically.

In the present embodiment, two-component developer including nonmagnetic toner and magnetic carrier is used.

For example, the magnetic carrier in developer includes a core of ferrite whose main component is iron oxide, magnetite, or iron power, and the core is coated with resin. Specific examples of coating of carrier include amino resins such as urea-formaldehyde resin, melamine resin, benzoguanamine resin, urea resin, and polyamide resin.

Also usable are polyvinyl resins and polyvinylidene resins, such as acrylic resin, polymethyl methacrylate resin, polyacrylonitrile resin, polyvinyl acetate resin, polyvinyl alcohol resin, polyvinyl butyral resin, polystyrene resin; and resins of polystyrene, styrene-acrylic copolymer, and the like. Alternatively, halogenated olefin resins such as polyvinyl chloride; and resins of polyesters such as polyethylene terephthalate and polybutylene terephthalate are usable. Yet alternatively, polycarbonate resins, polyethylene resins, polyvinyl fluoride resins, polyvinylidene fluoride resins, poly(trifluoroethylene) resins, poly(hexafluoropropylene) resins, vinylidene fluoride-acrylic monomer copolymer, vinylidene fluoride-vinyl fluoride copolymer, fluoroterpolymer, such as, tetrafluoroethylene-vinylidene fluoride-non-fluoride monomer terpolymer, and silicone resins are usable.

Figure 18:
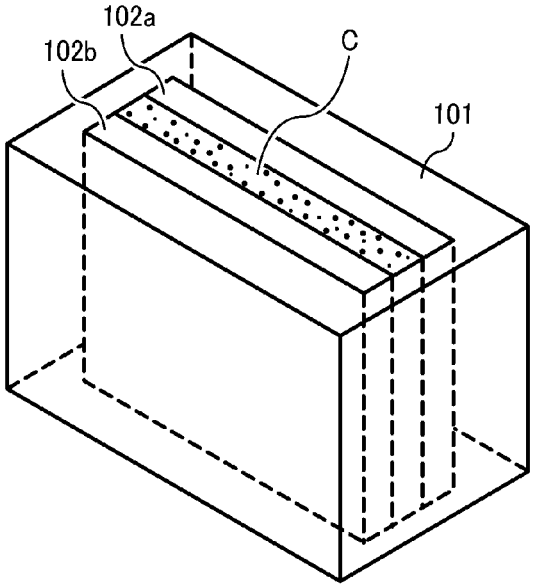
FIG. 18 is a perspective view of an exterior of a cell for measurement of a volume specific resistance of magnetic carrier.

FIG. 18 is a schematic perspective view of a cell 101, which is a fluoroplastic container, usable to measure the volume specific resistance of magnetic carrier.

Inside the cell 101, electrodes 102*a* and 102*b* are disposed, spaced at 2 mm, for example. Each of the electrodes 102*a* and 102*b* has a surface area of about 8 $cm^2$ (2 cm×4 cm). Following is an example measurement method. Fill the clearance between the electrodes 102*a* and 102*b* with powdered magnetic carrier C, and make the layer of magnetic carrier C uniform using a Sankyo tapping machine PTM-1 from Piotec Co., Ltd. Perform tapping for one minute at a speed of 30 times per minute. Subsequently, apply a direct voltage of 1000 V to the electrodes 102*a* and 102*b*. Using a high resistance meter 4329A (4329A+LJK5HVLVWDQFH0HWHU from Yokokawa-HEWLETT-PACKARD), measure direct-current resistance, obtain an electrical resistivity R (Ω·cm), and calculate Log R. In the present embodiment, the magnetic carrier of 10 Log Ω·cm is coated with amino resin.

Any toner usable in two-component developer is applicable for the present embodiment, and toner including a binder resin, a colorant, a release agent, a charge controller, an external additive, and the like is applicable.

Specific examples of binder resin include: styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-methyl vinyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutylmethacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, and the like. The examples above can be used independently or in combination.

Any known dyes and pigments are usable as the colorant. Specific examples of the colorants for toner usable in the present embodiment include any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, Oil Yellow, HANSA YELLOW (GR, A, RN, and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL, and F4RH), Fast Scarlet VD, VULCAN FAST RUBIN B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarin Lake, Thioindigo Red B, Thioindigo Maroon, Oil Red, Quinacridone Red, Pyrazolone Red, Chrome Vermilion, Benzine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, and the like. The examples above can be used independently or in combination.

As external additives, known inorganic fine particles and hydrophobic inorganic particles are usable. Examples of external additives include particles of silica, hydrophobic silica, fatty acid metallic salts (for example, zinc stearate and aluminum stearate), metal oxides (for example, titania, alumina, tin oxide, and antimony oxide), and fluoropolymers. In particular, hydrophobic silica, titania, alumina particles are preferable.

Specific examples of inorganic fine particles include titanium oxide, barium titanate, magnesium titanate, calcium titanate, strontium titanate, iron oxide, copper oxide, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. In particular, silica and titanium dioxide are preferable.

Examples of the release agent include solid paraffin wax, micro wax, rice wax, fatty acid amide wax, fatty acid wax, aliphatic monoketone, fatty acid metallic salt wax, fatty ester wax, partially saponified fatty ester wax, silicone vanish, higher alcohol, and carnauba wax. It is to be noted that ingredients of developer usable in the embodiments are not limited to the examples mentioned above.

In two-component development using the magnetic carrier and the nonmagnetic toner described above, superimposed voltage in which AC (alternating current) voltage is superimposed on DC (direct current) voltage is used as the developing bias. However, a part of the casing 420 is made of metal and grounded electrically. Accordingly, when the developing bias is applied to the developer bearer, the superimposed voltage branches into two and flows to the latent image bearer (the photoconductor 18) and the casing 420. Consequently, the voltage applied to the latent image bearer is not the desired amount, and effects of the developing bias to alleviate granularity, which is an item to evaluate how images look grainy, and uneven image density are not fully attained. Simultaneously, white voids around solid portions can be worsened.

Descriptions are given below of the features of the present embodiment to attain the desired developing bias, with reference to FIG. 19.

Figure 19:
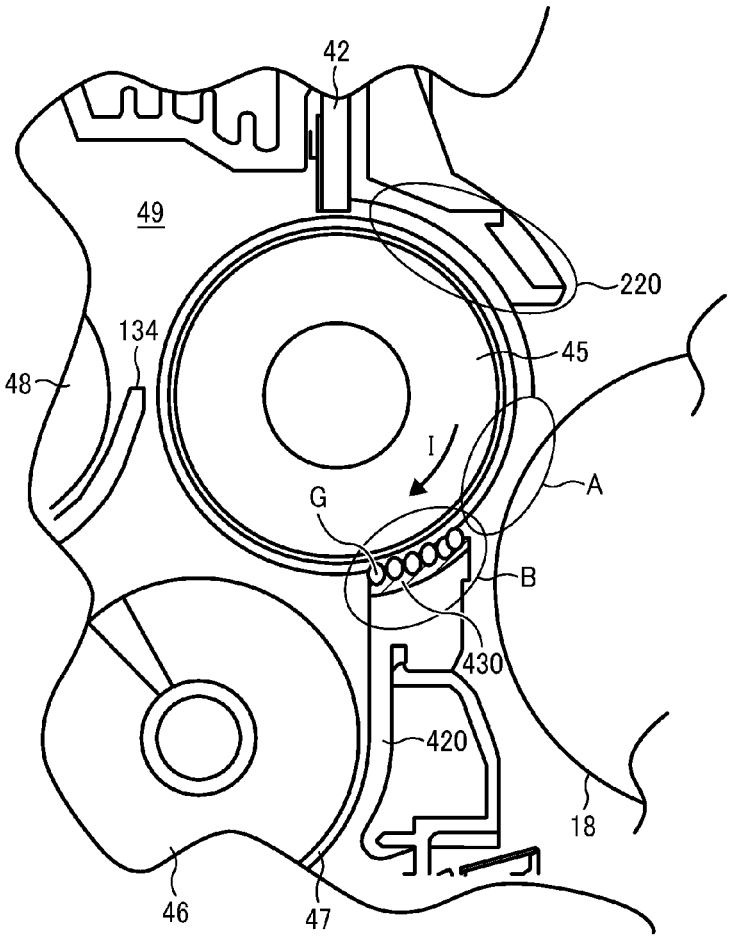
FIG. 19 is an enlarged view of a developing range according to the second embodiment.

FIG. 19 is an enlarged view around the developing range between the developing roller 45 and the photoconductor 18. In FIG. 19, a layer of developer G is borne on the developing roller 45.

On the left of the developing roller 45 in FIG. 19, the supply channel 49 and the supply screw 48 are situated, and the doctor blade 42 is disposed downstream from the supply screw 48 in the direction I, in which the developing roller 45 rotates. The upper roller cover 220 overhands from the doctor blade 42 to cover a part of the developing roller 45. Toner moves from the developing roller 45 to the photoconductor 18 in the area around the exposed portion of the developing roller 45 (not covered with the upper roller cover 220), opposing to the photoconductor 18 (i.e., the developing range A). Downstream from the developing range A in the direction I, the developing roller 45 faces the casing 420 (hereinafter "opposing area B"), and the portion of the developing roller 45 downstream from the opposing area B is positioned inside the casing 420. The downstream side of the opposing area B communicates with the collecting channel 47. The wall surrounding the supply channel 49 and the upper roller cover 220 are made of resin, and the doctor blade 42 and the portion of the casing 420 positioned in the opposing area B are made of metal in one embodiment.

When the developing bias is applied to the developing roller 45, electrical current flows between the developing roller 45 and the photoconductor 18 through the charged toner in the layer of developer G on the developing roller 45, and electrical current flows between the developing roller 45 and the casing 420 in the opposing area B similarly. Accordingly, the superimposed voltage serving as the developing bias branches to the photoconductor 18 and the casing 420. That is, the desired potential difference (i.e., developing bias) is not attained between the developing roller 45 and the photoconductor 18. It is to be noted that, although the doctor blade 42 includes metal, the potential of the doctor blade 42 is identical or similar to that of the developing roller 45 and does not matter.

In view of the foregoing, in the present embodiment, the portion of the casing 420 in the opposing area B is coated with a resistance layer 430 serving as a coating layer. The resistance layer 430 together with the layer of developer G on the developing roller 45 in the opposing area B serves as a current limiting resistor. In one embodiment, the resistance layer 430 includes PTFE tape (No. 5490 from 3M Japan Limited, for example) having a thickness of about 0.09 mm. The resistance layer 430 is higher in resistance than the layer of developer G between the developing roller 45 and the opposing area B. It is preferable that the resistance layer 430 is multilayered.

With the current limiting resistor, the desired potential difference for image developing (i.e., the developing bias) is attained between the developing roller 45 and the photoconductor 18. Therefore, grainy images, uneven image density, and white voids around solid image portions are alleviated.

Additionally, to ensure inhibition of the electrical current, in one embodiment, the portion of the casing 420 in the opposing area B includes an insulation layer, as a surface layer, made of insulative paint or insulative tape. In another embodiment, for example, a multilayered insulator including insulative paint and insulative tape is disposed on the portion of the casing 420 in the opposing area B. In this case, three layers of insulation including the layer of developer G is provided between the metal of the casing 420 and the developing roller 45.

The developing bias is described in further detail below.

In the present embodiment, the developing bias is superimposed voltage in which AC voltage is superimposed on DC voltage. For example, the superimposed voltage has a frequency of 8 kHz, a peak-to-peak voltage (Vpp) of 800 V, and a positive-side duty ratio of 50%. In the present embodiment, AC voltage is used also for the charging bias to charge the photoconductor 18 uniformly, and the frequency thereof is about 2.65 kHz.

When the frequency of the charging bias and that of the developing bias deviate from an integral multiple or 1 divided by an integral multiple, charging becomes uneven due to interference (undulation) between the charging bias frequency and the developing bias frequency, resulting in image density unevenness. Therefore, in practice, the developing bias frequency is a triple of the charging bias frequency (7.95 kHz in the present embodiment). In this specification, however, the developing bias is stated as 8 kHz for simplicity.

A description is now given of an AC voltage waveform of the superimposed voltage.

Figure 20:
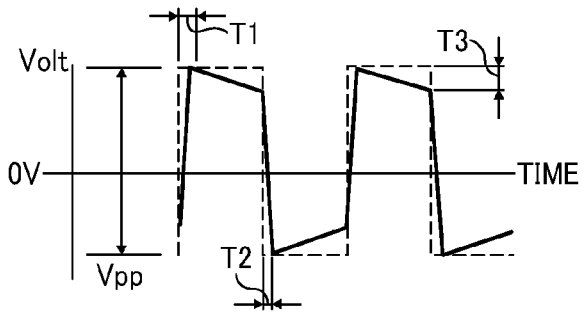
FIG. 20 is a graph of rectangular waveform for one cycle according to the second embodiment.

FIG. 20 is a schematic graph of a rectangular waveform for one cycle.

In FIG. 20, the abscissa represents time in seconds (s), and the ordinate represents voltage (V). An offset voltage (a DC component of the superimposed voltage) is 0 V in FIG. 20. The rectangular wave according to the present embodiment is indicated by solid lines, and an ideal waveform is indicated by broken lines.

Each of a voltage rise time T1 and a voltage fall time T2 of the rectangular wave according to the present embodiment is specified from about 15 μs and 20 μs. As illustrated in FIG. 20, the voltage rise time T1 is a time span during which the voltage rises from 10% of the peak to 90% of the peak. Similarly, the voltage fall time T2 is a time span during which the voltage descends to 10% from 90% of the peak.

The occurrence of voids around solid portions and uneven image density in output images were observed while the voltage rise time T1 and the voltage fall time T2 of the superimposed voltage were changed. The output images were evaluated with eyes, and Table 6 shows ratings thereof. As the ratings, "Good" means that the image includes no image failure, "Acceptable" means that the image includes slight, an acceptable level of image failure, and "Poor" means that the mage failure is an unacceptable level.

TABLE 6

| Voltage rise/fall time (μs) | Image density uniformity | Voids around solid portions |
|---|---|---|
| 10 | Good | Poor |
| 15 | Good | Good |
| 20 | Good | Good |
| 25 | Poor | Good |

According to Table 6, to balance image density uniformity and inhibition of voids around solid portions, the voltage rise time T1 and the voltage fall time T2 are longer than 10 μs and shorter than 25 μs. In one embodiment, the voltage rise time T1 and the voltage fall time T2 are from 15 μs to 20 μs.

In FIG. 20, in the graph of the ideal waveform indicated by broken lines draws a flat lateral line (voltage does not change with time) while the voltage is at the peak. To keep the graph of waveform flat, it is conceivable that a switching power source is used to switch the power between a positive power source and a negative power source and a cooling device is used to prevent voltage drop due to heat. In this case, however, the cost is higher since a switch durable against voltage at the switching and the cooling device are used, and the space of the apparatus increases.

In the present embodiment, to keep the cost and space smaller and secure image quality, a transformer-type power source is used, and the peak voltage is caused to increase or decrease with time to approach the offset voltage. In other words, as indicated by reference character T3, the voltage decreases toward 0 V.

The direction of transition of peak voltage toward the offset voltage (hereinafter "sag") is defined as positive when the peak voltage increases, and that is defined as negative when the peak voltage decreases. Further, the term "change rate" used below means the value obtained by dividing the amount by which voltage changes by single-side peak voltage.

For example, when the peak-to-peak voltage (Vpp) of the superimposed voltage is 1000 V and the sag is 1%, the amount by which the peak voltage drops (or rises) is 5 V, which is 1% of the single-side peak voltage.

The occurrence of voids around solid portions was observed while the sag of the superimposed voltage was changed. The output images were evaluated with eyes, and Table 7 shows ratings thereof. As the ratings, "Good" means that the image includes no image failure, "Acceptable" means that the image includes slight, an acceptable level of image failure, and "Poor" means that the mage failure is an unacceptable level.

TABLE 7

| Sag | Voids around solid portions |
|---|---|
| 5% | Good |
| 10% | Acceptable |
| 15% | Poor |

According to Table 7, to keep voids around solid portions to an acceptable level, the sag is about 10% or smaller. In one embodiment, the sag is 5% or smaller. To keep the sag smaller than 5%, however, the switching power source and the cooling device are necessary. Accordingly, setting the sag of the rectangular wave at about 5% is advantageous to secure image quality while keeping the cost and the space of the apparatus smaller.

It is to be noted that, although the description above concerns the rectangular wave, the waveform of AC voltage is not limited thereto. A sine wave, a triangular wave, a rectangular wave, or a combination thereof may be used.

Figure 21A:
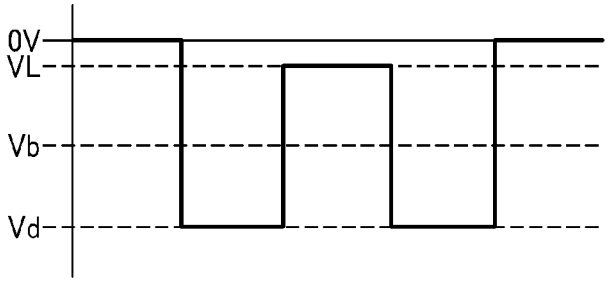
FIGS. 21A, 21B, and 21C are graphs of photoconductor potentials after charging, potential after exposure, and developing bias according to the second embodiment.
Figure 21B:
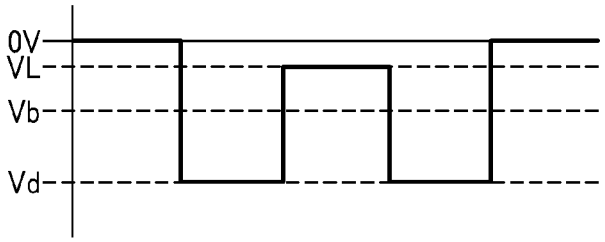
Figure 21C:
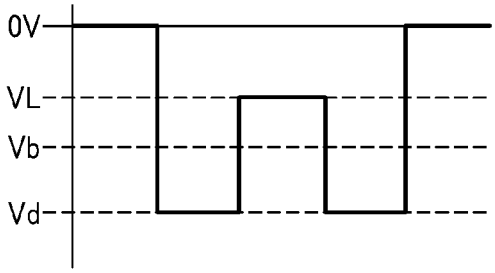

Referring to FIGS. 21A, 21B, and 21C, developing conditions, namely, the potential of the photoconductor 18 after charging (Vd), the potential of the photoconductor 18 after exposure (VL), and the developing bias (Vb) are described. FIGS. 21A and 21B are graphs of the developing conditions according to comparative examples, and FIG. 21C is a graph of those according to the present embodiment.

The potential of the uniformly charged photoconductor 18 (hereinafter "post-charging potential Vd") is changed to the potential VL (hereinafter "post-exposure potential VL") by exposure. When the developing bias Vb is applied thereto, a toner image is formed on the photoconductor 18. The difference between the post-exposure potential VL and the developing bias Vb is called "developing potential".

When the developing bias includes DC voltage only, the respective potentials are in the relation illustrated in FIG. 21A. The superimposed voltage enhances developing capability, and the developing potential can be reduced as illustrated in FIGS. 21B and 21C. This is advantageous in inhibiting an edge electrical field arising in halftone areas around the solid portion and accordingly effective in inhibiting voids around solid portions.

In FIG. 21B, in reducing the developing potential, the post-charging potential Vd is reduced. In this case, however, the potential of the photoconductor 18 is small, and the photoconductor 18 is susceptible to another bias (such as the transfer bias applied to the intermediate transfer member). Then, the possibility of afterimage is higher, resulting in uneven image density.

In view of the foregoing, in the present embodiment, the post-exposure potential VL is made greater in absolute value than that in FIG. 21A or 21B as illustrated in FIG. 21C when the developing potential is reduced. With this configuration, the post-charging potential Vd can be made similar to that in the configuration in which the developing bias is DC voltage. Accordingly, the occurrence of afterimage is suppressed, alleviating uneven image density. Additionally, since the developing potential is smaller, voids around solid portions are alleviated.

It is to be noted that the method of increasing the post-exposure potential in absolute value includes, but not limited to, changing the strength of laser light emitted from the exposure device 9 (in FIG. 2).

Figure 22:
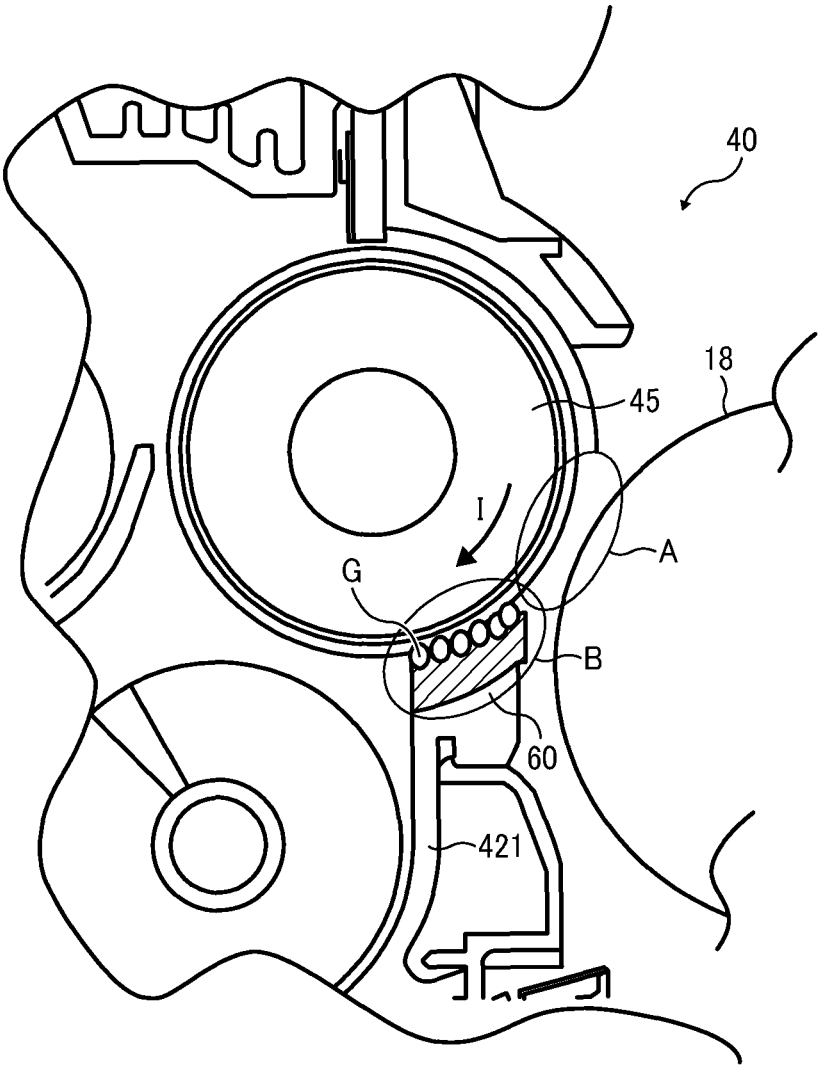
FIG. 22 is an enlarged view of a developing range in a developing device according to a variation.

FIG. 22 is an enlarged view of a developing range according to a variation. In FIG. 22, elements similar to those illustrated in FIG. 19 are given identical or similar reference characters, and thus descriptions thereof omitted.

A casing 421, serving as the developer container, of the developing device 40 illustrated in FIG. 22 is different from the casing 420 illustrated in FIG. 19 in that the part opposing to the developing roller 45 is a separate component (hereinafter "casing end portion 60"). When the casing end portion 60 and the casing 421 are separate components, that is, the casing end portion 60 is not monolithic with the casing 421 and is attached thereto, the gap between the developing roller 45 and the casing 421 is easily adjustable. Accordingly, this configuration facilitates adjustment of sucking-in airflow flowing into the casing 421, for inhibition of toner scattering while developer is transported.

When the casing end portion 60 is made of metal identical or similar to that (aluminum in one embodiment) of the casing 421, at least a single coating layer (similar to the resistance layer 430 illustrated in FIG. 19) higher in resistance than a developer layer is provided, as a current limiting resistor, on the casing end portion 60. With this configuration, effects similar to those attained by the first embodiment are attained.

In another embodiment, the casing end portion 60 is a separate component from the casing 421 (i.e., a casing body), and the casing end portion 60 is made of resin and serves as a current limiting resistor. In this case, the resin casing end portion 60 serves as a resin layer (an insulation layer) interposed between the casing 421 and the developing roller 45. With this configuration, effects similar to those attained by the first embodiment are attained.

Effects attained by the second embodiment and variation were experimentally evaluated as follows. Images were formed on sheets using the developing devices 40 according to the second embodiment (in FIG. 19), the variation thereof (in FIG. 22), and a comparative example in which the resistance layer is not provided in the opposing area B between the developing roller 45 and the casing 420. Other than that, the comparative example is similar to the configuration illustrated in FIG. 19 or 22.

[Developing Conditions]

As developing conditions, DC voltage, Superimposed voltage 1, and Superimposed voltage 2 were used. In Superimposed voltage 1, the post-charging potential Vd of the photoconductor 18 was reduced as illustrated in FIG. 21B. In Superimposed voltage 2, the post-exposure potential VL was increased as illustrated in FIG. 21C.

Table 8 shows voltage in the respective developing conditions.

TABLE 8

| | DC voltage | Superimposed voltage 1 | Superimposed voltage 2 |
|---|---|---|---|
| Vd (−V) | 500 | 340 | 480 |
| Vb (−V) | 400 | 200 | 340 |
| VL (−V) | 110 | 100 | 240 |
| Developing potential (V) | 290 | 100 | 100 |

[Superimposed Voltage]

For the superimposed voltage, a rectangular wave (AC voltage) was superimposed on the offset voltage (DC voltage). The rectangular wave had a frequency of 8 kHz, a peak-to-peak voltage (Vpp) of 800 V, and a positive-side duty ratio of 50%. The voltage rise time and the voltage fall time were 15 μs, and the sag was 5%. The offset voltage was set such that an area average value of the superimposed voltage waveform was at the developing bias Vb (see Table 8).

[Evaluated Images]

Figure 23:
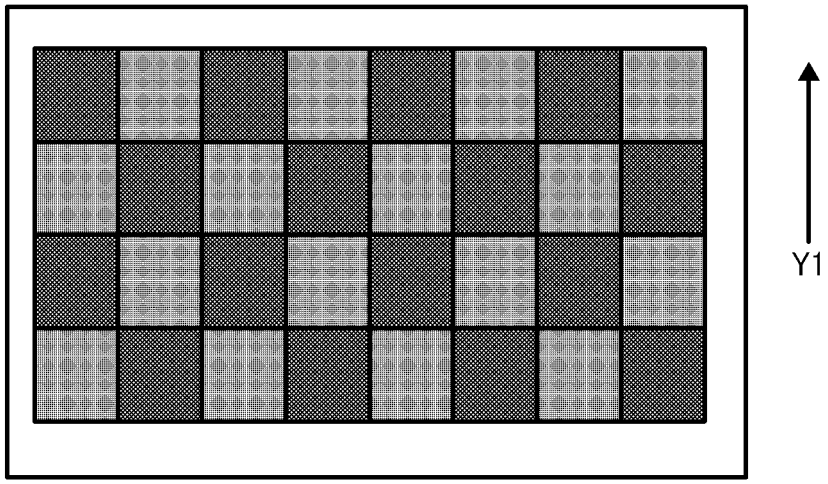
FIG. 23 is an illustration of a check pattern image for evaluation in the second embodiment.
Figure 24:
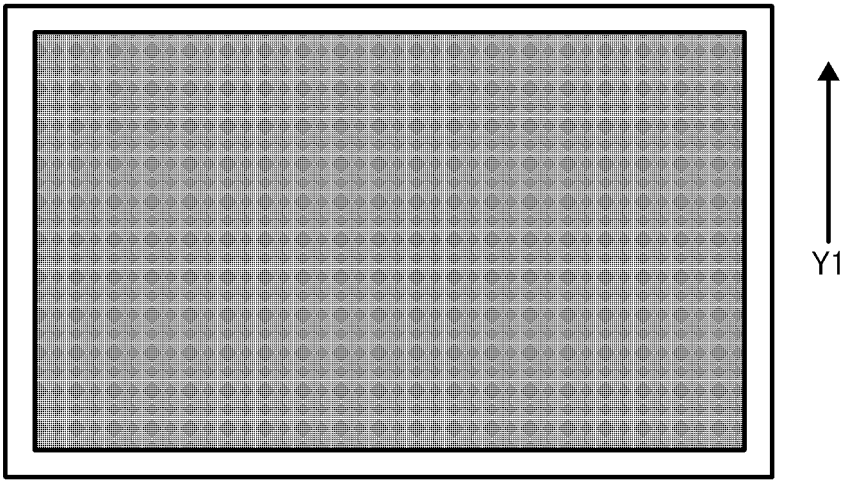
FIG. 24 is an illustration of a halftone image for evaluation in the second embodiment.

For evaluation, an image in which solid portions and halftone portions were in check arrangement (hereinafter "check image") as illustrated in FIG. 23, and an image having an image area ratio (dot area ratio) of 75% (hereinafter "halftone image") as illustrated in FIG. 24 were used. In FIGS. 23 and 24, reference character Y1 represents the direction in which the sheet is fed. The check image was evaluated for granularity and voids around solid portions, and the halftone image was evaluated for uneven image density. It is to be noted that image density difference is most noticeable in the halftone image among the images evaluated by the inventors.

The images evaluated were formed on Ricoh plain paper Type 6000 (70 W). This paper weighs 70 g per square meters and is A4 in size.

[Evaluation Method]

The output images were evaluated with eyes. As the ratings, "Good" means that the image includes no image failure, "Acceptable" means that the image includes slight, an acceptable level of image failure, and "Poor" means that the mage failure is an unacceptable level.

The ratings thereof are shown in Table 9 below.

TABLE 9

| Developing bias | Configuration | Granularity | Uneven image density | Voids around solid portions |
|---|---|---|---|---|
| DC voltage | Comparative example | Acceptable | Acceptable | Acceptable |
| | Embodiment 2 | Acceptable | Acceptable | Acceptable |
| | Variation | Acceptable | Acceptable | Acceptable |
| Superimposed voltage 1 | Comparative example | Good | Acceptable | Poor |
| | Embodiment 2 | Good | Acceptable | Good |
| | Variation | Good | Acceptable | Good |
| Superimposed voltage 2 | Comparative example | Good | Good | Poor |
| | Embodiment 2 | Good | Good | Good |
| | Variation | Good | Good | Good |

When the developing bias was DC voltage, the acceptable level of image failure occurred in all of the configurations in Table 9, and there were no noticeable differences in image quality among them.

In the case of Superimposed voltage 1 as the developing bias, granularity was good in all of the configurations in Table 9 and thus better compared with the case of DC voltage. Voids around solid portions were improved in Embodiment 2 and variation compared with the case of DC voltage but worsened in Comparative example 1 compared with the case of DC voltage. Image density uniformity was affected by afterimages, and the ratings of uneven image density was similar to those in the case of DC voltage.

In the case of Superimposed voltage 2 as the developing bias, granularity was improved in all of the configurations in Table 9 compared the case of DC voltage. Although worsened in Comparative example 1 compared with the case of DC voltage, voids around solid portions were improved in Embodiment 2 and variation compared with the case of DC voltage. Afterimages were suppressed, and thus effects of superimposed voltage in alleviating uneven image density were attained. It is conceivable that uneven image density was alleviated because the post-charging potential Vd was similar to that in the case in which the developing bias was DC voltage.

Thus, the evaluation results described above confirm that use of Superimposed voltage 1 as the developing bias is advantageous in alleviating granularity and voids around solid portions. Additionally, the evaluation results described above confirm that uneven image density was further alleviated by use of Superimposed voltage 2 as the developing bias.

It is to be noted that the above-described embodiments are representatives, and the scope of the present application is not limited thereto. Although the copier is described above as the image forming apparatus 500 incorporating the developing device 40 according to the embodiments, the developing device 40 can adapt to other types of image forming apparatuses such as facsimile machines, printers, and the like.

The various aspects of the present specification can attain specific effects as follows.

Aspect A: A developing device (such as the developing device 40) includes a developer bearer (such as the developing roller 45) to bear developer including toner and magnetic carrier on its surface and carry by rotation the developer to a development range facing a latent image bearer (such as the photoconductor 18); a casing (such as the casing body 121 and the gap adjuster 112) including channel walls to define a developer compartment (such as the agitation channel 44, the collecting channel 47, and the supply channel 49) to contain the developer supplied to the developer bearer as well as an opening (such as the opening 51) through which a part of the developer bearer disposed in the casing faces the latent image bearer; and a developing bias source (such as the power source 141) to apply a developing bias to the developer bearer.

In the above-described configuration, the casing includes an opposed portion (such as the opposing face 112A) opposing to and positioned close to, across a small gap (i.e., the casing gap), a surface of the developer bearer downstream from the developing range in the direction in which the developer bearer rotates. The distance from the opposed portion to the surface of the developer bearer (i.e., the size of the casing gap) is designed such that the developer borne on the developer bearer contacts the opposing face of the casing. The portion (such as the gap adjuster 112) of the casing that defines the casing gap includes a conductive material, and an insulation layer (such as the insulation layer 123) is provided to the opposing face of the casing that contacts the developer on the developer bearer.

With this configuration, image density can be kept stable while inhibiting the scattering of developer downstream from the developing range from the following factors.

The developer on the developer bearer is caused to contact the opposing face of the casing, and thus the airflow flowing out the casing is inhibited. Accordingly, a stable sucking-in airflow is generated downstream from the developing range. Thus, the scattering of developer downstream from the developing range is suppressed.

The inventors recognize the possibility of decreases in image density of solid images in configurations in which the developer on the developer bearer is caused to contact the casing at the casing gap. According to understanding of the inventors, in such a case, the developer that has passed through the developing range does not leave the developer bearer in the release portion and reaches the supply portion in which developer is supplied from the supply channel to the developer bearer (i.e., carry-over of developer). Then, the developer reduced in toner concentration is supplied to the developing range, and the image density of solid images decreases.

The inventors experimentally found that disposing the insulation layer on the opposing face of the casing, with which the developer on the developer bearer is brought into contact, is effective in suppressing carry-over of developer.

The developer reduced in toner concentration is prevented from being supplied to the developing range by preventing the occurrence of carry-over of developer. Thus, decreases in image density are inhibited, thereby stabilizing the image density.

Disposing the insulation layer on the opposing face of the casing is effective as follows.

In the casing gap, electrical field is generated between the developer bearer, to which the developing bias is applied, and the conductive opposing face of the casing facing the developer bearer, and electrostatic force in the direction toward the opposing face of the casing acts on the toner in developer on the developer bearer. If toner attracted by this action adheres to the opposing face of the casing electrostatically, counter charges of polarity opposite to that of toner are caused on carrier in developer remaining on the developer bearer, and the adhesion of developer to the developer bearer increases. Consequently, the developer fails to leave the developer bearer in the release portion, resulting in carry-over of developer.

According to Aspect A, when the insulation layer is provided to the opposing face disposed at the desired casing gap from the developer bearer, the distance between the conductive opposing face of the casing and the surface of the developer bearer is increased from the desired casing gay by the amount equivalent to the thickness of the insulation layer. Even if the potential difference between the opposing face of the casing and the surface of the developer bearer is the same or similar, the electrical field therebetween is weakened as the distance therebetween increases. Accordingly, the electrostatic force to move the toner to the opposing face of the casing is weakened. With this action, electrostatic adhesion of toner to the opposing face of the casing is inhibited, thereby reducing counter charges caused in the developer borne on the developer bearer and suppressing increases in electrostatic adhesion of developer to the developer bearer. Accordingly, separation of developer from the developer bearer in the release portion is promoted, and carry-over of developer is inhibited.

Aspect B: In Aspect A, the insulation layer includes an insulative resin coating layer of the opposing face of the casing (such as the gap adjuster 112).

According to Aspect B, the resin coating that does not include an adhesive layer is advantageous in preventing contact between an adhesive material and developer even when the insulation layer is abraded over time.

Aspect C: In Aspect A or B, the angle of contact with water of the insulation layer is 95° or greater.

This configuration inhibits accumulation of toner on the opposing face of the casing (such as the gap adjuster 112) opposing to the latent image bearer and accordingly inhibits adhesion of toner thereto.

Aspect D: In any of Aspects A, B, and C, the volume resistivity of the insulation layer is $1\times10^{14}$ Ω/cm or greater.

As described above, this configuration can secure prevention of carry-over of developer.

Aspect E: In any of Aspects A through D, the layer thickness of the insulation layer is 30 μm or greater.

As described above, with this configuration, the insulation layer is maintained for a long time, and carry-over of developer and resultant image density decrease are suppressed.

Aspect F: In any of Aspects A through E, in the width direction, which is perpendicular to the direction of rotation of the developer bearer, ends of the insulation layer are aligned with or disposed outside ends of the developing range.

This configuration is effective in inhibiting the occurrence of carry-over of developer in the developing range entirely in the width direction.

Aspect G: In any of Aspects A through F, the casing of the developing device is disposed facing the surface of the developer bearer across a gap, thereby defining the casing gap. The casing includes a casing body, such as the casing body 121, which includes walls to enclose the developer compartments such as the agitation channel 44, the collecting channel 47, and the supply channel 49. The casing further includes a gap adjuster, such as the gap adjuster 112, made of a conductive material and separated from the casing body.

According to this aspect, the size of the casing gap is adjustable easily.

Aspect H: In Aspect G, the gap adjuster is secured to the casing body by a metal screw such as the screw 501 disposed such that the head of the screw is situated on a face of the gap adjuster opposing to the latent image bearer. The developing device further includes a nonmagnetic cover such as the entrance seal 50 to cover the head of the screw on the face of the gap adjuster.

According to this configuration, adhesion of carrier on the face of the gap adjuster, opposing to the latent image bearer, is inhibited.

Aspect I: An image forming apparatus, such as the image forming apparatus 500 illustrated in FIG. 2, includes the latent image bearer, a charging device to charge the surface of the latent image bearer, an exposure device to form an electrostatic latent image on the latent image bearer, and the developing device according to any of aspects A through H.

With this configuration, image density can be kept stable while inhibiting the scattering of developer downstream from the developing range. Thus, the occurrence of image failure caused by the developer coming out of the developing device is inhibited, and the image density is kept stable, thereby enhancing image quality. Additionally, smear with developer of the interior of the apparatus is inhibited.

Aspect J: A process cartridge, such as the image forming unit 11, removably installed in an image forming apparatus, includes at least the latent image bearer, the developing device according to any of aspects A through H, and a common unit casing to house those components.

This configuration facilitates replacement of the developing device capable of keeping the image density stable while inhibiting the scattering of developer downstream from the developing range.

Aspect K: A developing device includes a casing, at least a partly of which is made of metal and grounded electrically; a developer bearer configured to carry developer and including a developing sleeve and a magnetic field generator disposed inside the developing sleeve; and a developing bias source to apply a developing bias in which AC voltage is superimposed on DC voltage. The casing contains two-component developer including nonmagnetic toner and magnetic carrier. Multiple recesses shaped circular or oval in a plan view are spaced apart, either regularly or irregularly, on the surface of the developing sleeve not to overlap each other. The developing sleeve includes a low friction layer lower in friction coefficient than a base material of the developing sleeve. A current limiting resistor is disposed in an opposed portion where the developer bearer faces the casing adjacent to and downstream from the developing range in the direction of rotation of the developer bearer.

Aspect L: In Aspect K, the current limiting resistor includes a layer of two-component developer and at least a single resistance layer higher in resistance than the developer layer, and the resistance layer is disposed on the opposed portion of the casing.

Aspect M: In Aspect K, the current limiting resistor includes a layer of two-component developer and an insulation layer on the developer bearer in the opposed portion.

Aspect N: In Aspect K, the casing includes a casing body and a casing end portion opposing to the developer bearer and attached to the casing body. The casing end portion is made of metal. The casing end portion is adjacent to and downstream from the developing range in the direction of rotation of the developer bearer. At least a single resistance layer higher in resistance than the developer layer is provided to the casing end portion.

Aspect O: In Aspect K, the casing includes a casing end portion separated from a casing body and opposing to the developer bearer, and the casing end portion is made of resin. The resin casing end portion serves as the insulation layer disposed in the portion where the casing opposes to the developer bearer.

Aspect P: In any of Aspects K through O, the developer bearer has a main pole that exerts a normal direction magnetic flux having an attenuation ratio of about 40% or greater, and the attenuation ratio used here is defined as a ratio obtained by dividing, with the peak value of the normal direction magnetic flux on the surface of the developing sleeve, the difference between the peak value of the normal direction magnetic flux on the surface of the developing sleeve and that at 1 mm away from the surface of the developing sleeve.

Aspect Q: In any of Aspects K through P, in the superimposed voltage serving as the developing bias, the peak voltage does not change for a given time theoretically, the peak voltage increases or decreases with time to approach the offset voltage, and the rate at which the peak voltages approaches the value of the DC component is specified.

Aspect R: In any of Aspects K through Q, the superimposed voltage has a waveform such that a time span during which the voltage rises from 10% of the peak to 90% of the peak and a time span during which the voltage descends to 10% from 90% of the peak are specified.

Aspect S: In any of Aspects K through R, the frequency of the superimposed voltage is an integral multiple or 1 divided by an integral multiple of the frequency of the charging bias.

Aspect T: In any of Aspects K through S, the post-exposure potential of the latent image bearer in the case in which the developing bias is the superimposed voltage is greater in absolute value than the post-exposure potential of the latent image bearer in the case in which the developing bias is DC voltage.

Aspect U: In any of Aspects K through T, the casing includes a cooling portion.

Aspect V: In Aspect U, the cooling portion is a radiating rib monolithic with the casing.

Aspect W: In Aspect U, the cooling portion is a liquid-cooling device adjacent to the casing.

Aspect X: A process cartridge that is removably installable in an image forming apparatus includes the developing device according to any one of Aspects K through W and at least one of the latent image bearer, a charging device, and a cleaning device. The components of the process cartridge are housed in a common unit casing.

Aspect Y: An image forming apparatus includes at least one developing device according to any one of Aspects K through W.

Aspect Z: An image forming apparatus includes multiple process cartridges, each of which is according to Aspect X.

Numerous additional modifications and variations are possible in light of the above teachings. It is therefore to be understood that, within the scope of the appended claims, the disclosure of this patent specification may be practiced otherwise than as specifically described herein.

What is claimed is:

1. A developing device comprising:

a developer bearer to carry, by rotation, developer including toner and magnetic carrier to a developing range facing a latent image bearer;

a casing including a developer container to contain the developer and an opening through which a part of the developer bearer disposed in the casing faces the latent image bearer;

the casing including an opposing face opposing to a surface of the developer bearer downstream from the developing range in a direction of rotation of the developer bearer across a distance, the opposing face including a conductive material and disposed across a casing gap from the developer bearer, the casing gap sized to allow the developer borne on the developer bearer to contact the opposing face;

a developing bias source to apply a developing bias to the developer bearer; and an insulation layer disposed on the opposing face of the casing that is free from contact with the latent image bearer.

2. The developing device according to claim 1, wherein the insulation layer comprises an insulative resin coating applied to the opposing face of the casing.

3. The developing device according to claim 1, wherein:

the developing device is in contact with a heat receiver of a liquid cooling system that utilizes water as a coolant, and the insulation layer has an angle of contact with the water of 95 degrees or greater.

4. The developing device according to claim 1, wherein the insulation layer has a volume resistivity of $1\times10^{14}$ Ω/cm or greater.

5. The developing device according to claim 1, wherein the insulation layer has a thickness of 30 μm or greater.

6. The developing device according to claim 1, wherein the developing range is positioned within the insulation layer in a width direction perpendicular to the direction of rotation of the developer bearer.

7. The developing device according to claim 1, wherein the casing comprises:

a casing body to enclose the developer container; and a gap adjuster made of a conductive material and including the opposing face, the gap adjuster removably secured to the casing body.

8. The developing device according to claim 1, wherein:

the casing comprises:

a casing body to enclose the developer container; and a gap adjuster made of a conductive material and including the opposing face, the gap adjuster removably secured to the casing body, the developing device further comprises:

a metal screw to secure the gap adjuster to the casing body; and a nonmagnetic cover to cover a face of the gap adjuster on which a head of the metal screw is disposed.

9. The developing device according to claim 1, further comprising:

a charging device to charge a surface of the latent image bearer, wherein the developing device to develop an electrostatic latent image on the latent image bearer.

10. The developing device according to claim 1, wherein:

the developer bearer includes:

multiple recesses on a surface of the developer bearer;

a low friction layer lower in friction coefficient than a base material of the developer bearer; and a current limiting resistor disposed on the casing and opposing to the surface of the developer bearer adjacent to and downstream from the developing range in a direction of rotation of the developer bearer across a distance, wherein at least a part of the developer container is made of metal and grounded electrically.

11. The developing device according to claim 1, wherein:

the developer bearer includes:

multiple recesses on a surface of the developer bearer;

a low friction layer lower in friction coefficient than a base material of the developer bearer; and a current limiting resistor disposed on the casing and opposing to the surface of the developer bearer adjacent to and downstream from the developing range in a direction of rotation of the developer bearer across a distance, wherein at least a part of the developer container is made of metal and grounded electrically, and wherein the casing comprises:

a casing body, and a casing end portion attached to the casing body and opposing to the surface of the developer bearer adjacent to and downstream from the developing range in the direction of rotation of the developer bearer, the casing end portion made of metal, and the current limiting resistor is disposed on the casing end portion and includes a coating layer higher in resistance than a layer of developer carried on the developer bearer.

12. The developing device according to claim 1, wherein:

the developer bearer includes:

multiple recesses on a surface of the developer bearer;

a low friction layer lower in friction coefficient than a base material of the developer bearer; and a current limiting resistor disposed on the casing and opposing to the surface of the developer bearer adjacent to and downstream from the developing range in a direction of rotation of the developer bearer across a distance, wherein at least a part of the developer container is made of metal and grounded electrically, and the casing comprises a metal casing body, and the current limiting resistor is made of resin and attached to the metal casing body.

13. The developing device according to claim 1, wherein:

the developer bearer includes:

multiple recesses on a surface of the developer bearer;

a low friction layer lower in friction coefficient than a base material of the developer bearer; and a current limiting resistor disposed on the casing and opposing to the surface of the developer bearer adjacent to and downstream from the developing range in a direction of rotation of the developer bearer across a distance, wherein at least a part of the developer container is made of metal and grounded electrically, and the casing comprises a radiating rib monolithic with a casing body of the casing.

14. A developing device comprising:

a developer bearer to carry, by rotation, developer including toner and magnetic carrier to a developing range facing a latent image bearer;

a casing including a developer container to contain the developer and an opening through which a part of the developer bearer disposed in the casing faces the latent image bearer;

the casing including an opposing face opposing to a surface of the developer bearer downstream from the developing range in a direction of rotation of the developer bearer across a distance, the opposing face including a conductive material and disposed across a casing gap from the developer bearer, the casing gap sized to allow the developer borne on the developer bearer to contact the opposing face;

a developing bias source to apply a developing bias to the developer bearer; and an insulation layer disposed on the opposing face of the casing, wherein the developing device is in contact with a heat receiver of a liquid cooling system that utilizes water as a coolant, and the insulation layer has an angle of contact with the water of 95 degrees or greater.

15. A developing device comprising:

a developer bearer to carry, by rotation, developer including toner and magnetic carrier to a developing range facing a latent image bearer;

a casing including a developer container to contain the developer and an opening through which a part of the developer bearer disposed in the casing faces the latent image bearer;

the casing including an opposing face opposing to a surface of the developer bearer downstream from the developing range in a direction of rotation of the developer bearer across a distance, the opposing face including a conductive material and disposed across a casing gap from the developer bearer, the casing gap sized to allow the developer borne on the developer bearer to contact the opposing face;

a developing bias source to apply a developing bias to the developer bearer; and an insulation layer disposed on the opposing face of the casing, wherein the casing comprises:

a casing body to enclose the developer container; and a gap adjuster made of a conductive material and including the opposing face, the gap adjuster removably secured to the casing body.

* * * * *